US010309151B2

(12) United States Patent
Tseng

(10) Patent No.: US 10,309,151 B2
(45) Date of Patent: Jun. 4, 2019

(54) AUTOMATIC AUTO-SENSING FLOOD PROTECTION ROLLER SHUTTER WITH AUTO-LOCATING REINFORCED COLUMN

(71) Applicant: Long-Yuan Tseng, New Taipei (TW)

(72) Inventor: Long-Yuan Tseng, New Taipei (TW)

(73) Assignee: Li-Yu Tseng, New Taipei (TW)

( * ) Notice: Subject to any disclaimer, the term of this patent is extended or adjusted under 35 U.S.C. 154(b) by 0 days.

(21) Appl. No.: 15/688,514

(22) Filed: Aug. 28, 2017

(65) Prior Publication Data

US 2018/0230732 A1 Aug. 16, 2018

Related U.S. Application Data

(63) Continuation-in-part of application No. 14/035,976, filed on Sep. 25, 2013.

(30) Foreign Application Priority Data

May 24, 2013 (TW) ..... 102118322 A

(51) Int. Cl.

| | |
|---|---|
| ***E06B 9/06*** | (2006.01) |
| ***E05F 15/72*** | (2015.01) |
| ***E05F 15/57*** | (2015.01) |
| ***E04H 9/14*** | (2006.01) |
| ***E05F 15/668*** | (2015.01) |
| ***E05D 15/56*** | (2006.01) |
| *E06B 9/00* | (2006.01) |

(52) U.S. Cl.

CPC ..... *E06B 9/0676* (2013.01); *E04H 9/145* (2013.01); *E05D 15/56* (2013.01); *E05F 15/57* (2015.01); *E05F 15/668* (2015.01); *E05F 15/72* (2015.01); *E06B 9/0638* (2013.01); *E06B 9/0653* (2013.01); *E05Y 2201/454* (2013.01); *E05Y 2400/32* (2013.01); *E05Y 2400/44* (2013.01); *E05Y 2800/252* (2013.01); *E05Y 2900/146* (2013.01); *E06B 2009/007* (2013.01)

(58) Field of Classification Search

USPC ..... 160/209

See application file for complete search history.

(56) References Cited

U.S. PATENT DOCUMENTS

| | | | | | |
|---|---|---|---|---|---|
| 3,443,625 | A | * | 5/1969 | Moser | E05B 65/0021 160/181 |
| 3,732,913 | A | * | 5/1973 | Wrono | E06B 9/15 160/133 |
| 4,941,320 | A | | 7/1990 | Kersten | |
| 5,022,452 | A | | 6/1991 | Burrell | |
| 5,172,742 | A | * | 12/1992 | Iwasaki | E06B 9/0638 160/32 |
| 5,445,207 | A | * | 8/1995 | Romanelli | E05D 15/24 160/209 |
| 5,685,355 | A | * | 11/1997 | Cook | E06B 9/0638 160/201 |

(Continued)

*Primary Examiner* — Marcus Menezes

(74) *Attorney, Agent, or Firm* — Bacon & Thomas, PLLC

(57) ABSTRACT

An automatic auto-sensing flood protection roller shutter with auto-locating reinforced column includes a door plate composed of a plurality of door panels, at least one reinforced column automatically movable by a motor to a reinforcing position behind the door plate when the door plate is lowered upon sensing a flood, and a bolt and bolt driving device for securing the at least one reinforced column in the reinforcing position.

10 Claims, 25 Drawing Sheets

(56) References Cited

U.S. PATENT DOCUMENTS

| | | | | |
|---|---|---|---|---|
| 5,967,216 | A * | 10/1999 | Mancini | E06B 9/01 160/209 |
| 6,082,431 | A | 7/2000 | Decola | |
| 6,324,789 | B1 | 12/2001 | Stephen | |
| 6,776,210 | B2 * | 8/2004 | Wells | E06B 3/485 160/209 |
| 7,438,114 | B2 * | 10/2008 | Fowler | E05B 65/0021 160/209 |
| 7,469,737 | B2 | 12/2008 | Mullet | |
| 7,891,401 | B2 * | 2/2011 | Decola | E06B 3/485 160/209 |
| 8,371,356 | B2 * | 2/2013 | Manser | E06B 9/17 160/133 |
| 8,387,309 | B2 * | 3/2013 | Tseng | E06B 9/0638 49/197 |
| 2003/0026659 | A1 | 2/2003 | Wu | |
| 2004/0134629 | A1 * | 7/2004 | Wells | E06B 3/485 160/209 |
| 2005/0126721 | A1 * | 6/2005 | Fan | E05D 15/165 160/201 |
| 2007/0151677 | A1 * | 7/2007 | East | E06B 3/485 160/209 |
| 2007/0215294 | A1 | 9/2007 | Barrow | |
| 2009/0183842 | A1 | 7/2009 | Decola | |
| 2012/0005960 | A1 | 1/2012 | Tseng | |
| 2012/0227915 | A1 * | 9/2012 | Rodriguez | E05B 65/0021 160/202 |

* cited by examiner

AUTOMATIC AUTO-SENSING FLOOD PROTECTION ROLLER SHUTTER WITH AUTO-LOCATING REINFORCED COLUMN

BACKGROUND OF THE INVENTION

Field of the Invention

The invention relates to a flood protection roller shutter, particularly to an automatic auto-sensing flood protection roller shutter with a plurality of waterproof door panels, a downward-pressing hydraulic cylinder, a sideward-pressing hydraulic cylinder, at least an auto-locating reinforced column, a water level detector and an infrared detector.

Descriptions of the Related Art

In the prior art, such as the Taiwan patent entitled "Iron rolling door with escape structure" with U.S. Pat. No. 483,478, as shown in FIG. 10, the iron rolling door with escape structure has a rolling door (1), which is formed by splicing multiple rolling door panels (11); two side columns (2), which are provided on both sides of the rolling door (1); characterized in that: said rolling door (1) has one lower rolling panel (11') designed in separation/combination form, assembled by a coupling mechanism (not shown), which controls the separation/combination status, through an upper door panel spicing the upper portion thereof and a lower door panel splicing the lower portion thereof; and the side column (2) is divided by the height of the separation/combination form rolling door panels (11'), the upper section is set as a fixation side column (2) fixed to a wall, the lower section sets pivotally an outer bottom to the ground surface as an active side column (2*b*), and a coupling piece (not shown) is used to control the combination status of the active column (2*b*) and the fixation column (2*a*). However, the iron rolling door of prior art is a design without safe operation protection, is not waterproof, and needs to open and close the iron rolling door manually such that it is incompliant with an facilitate to use criterion, and cannot meet the requirement of an automatic auto-sensing flood protection roller shutter.

In another prior art, such as the U.S.A. patent entitled by "Movable Barrier Operator Having Passive Infrared Detector" with U.S. Pat. No. 6,737,968B1, as shown in FIG. 11, a ceiling (14) in the garage (12) is mounted with a garage door controller (10), said garage door operator (10) may operate a multipanel garage door (16), said multipanel garage door (16) is provided with multiple rollers (18) on both sides thereof, said rollers (18) roll in tracks (20) on both sides of the garage door (16), said garage door operator (10) contains one head unit (24), one rail assembly (26), one trolley (28) and one arm (30), wherein said aim (30) has one end thereof fixed to an upper portion (32) and the other end thereof fixed to said trolley (28), said trolley (28) slides in said rail assembly (26), said head unit (24) drives said trolley (28) and induces open and close of said multipanel garage door (16). Said iron rolling door of prior art also does not have a safe operating protection device, nor have a design with waterproof and automatic auto-sensing functions.

Thus, it is what the invention intends to disclose how to create an automatically auto-sensing flood protection roller shutter with auto-locating reinforced column, such that said roller shutter may achieve advantages of safe operation for waterproof and flood protection, enhancement of door panel strength, stable movement of door panel and equipment damage prevention, airtight and waterproof, easy containment, facilitate to use, protection of door panel structure and increase of door panel life, stable movement guiding from reinforced column, waterproof and dustproof of retaining base, automatic closing of cover plate as not used, operation of automatic auto-sensing flood protection roller shutter, auto-locating of reinforced column and strength improvement of water proof structure and flood protection.

SUMMARY OF THE INVENTION

The major purpose of the invention is to provide an automatic auto-sensing flood protection roller shutter with auto-locating reinforced column such that said roller shutter may achieve the advantages of safe operation for waterproof and flood protection, enhancement of door panel strength, stable movement of door panel and equipment damage prevention, airtight and waterproof, easy containment, facilitate to use, protection of door panel structure and increase of door panel life, stable movement guiding from reinforced column, waterproof and dustproof of retaining base, automatic closing of cover plate as not used, operation of automatic auto-sensing flood protection roller shutter, auto-locating of reinforced column and strength improvement of water proof structure and flood protection.

To achieve the purpose mentioned above, the automatic auto-sensing flood protection roller shutter with auto-locating reinforced column according to the invention includes a door plate, which is composed of a plurality of door panels, which may be disposed in between two frames or contained in a storage device; a casing, which is provided on the top of the door plate and the interior thereof is provided with a motor, a hydraulic pump, an automatic controller, an uninterruptible power system, a storage device, a downward-pressing hydraulic cylinder and a driving device; two frames mounted on two sides of the door plate to dispose a plurality of said door panels; a storage device, wherein on each of the left and right walls of which is provided respectively with an overhead rail in a horizontal direction and a guide rail in a vertical direction, each of the guide rails being bonded with a connecting branch rail respectively, and a gear being provided at the shortest distance between each of the overhead rails and each of the guide rails, a chain being engaged with each of the gears, each of the chains may move along with each of the overhead rails and each of the guide rails; a downward-pressing hydraulic cylinder, which is provided in said casing or frame, a downward-pressing plate being provided at the lower end thereof to press the door plate; a sideward-pressing hydraulic cylinder, which is provided in said frames, a push lever being connected to the lower end thereof; a water level detector, which is provided in underground space as a waterproof system to be turned on automatically once a certain water level is detected; a reinforced column, which is provided behind the door plate, and a first reinforced column driving motor provided at the upper end thereof and a second reinforced column driving motor provided in the driving device being provided to drive for transverse movement in a direction parallel to the door plate from a non-reinforcing position to a door plate reinforcing position, and the inner chamber at the lower end of the reinforced column being provided with a bolt and a vertical motor; and a driving device, which is provided at the lower portion in the casing, a fixation joint and a bearing set being provided at each of the two inner walls thereof, the two ends of a guiding rod being fixed respectively in said two fixation joints, one end of with the guiding screw and one end with the transmission shaft being fixed in each of said two bearing sets, wherein the other end of said guiding screw and the other end of said transmission shaft are butted mutually; a first reinforced column driving motor provided at the upper end of the reinforced column; and a second reinforced column driving motor being provided in the driving device.

In a preferred embodiment of the invention, a hand clamping prevention block piece, a V-shaped groove and a door plate fixation hole are provided at the upper ends of the two lateral surfaces of a plurality of said door panels of the door plate, respectively, a hand clamping prevention block piece, an inverted V-shaped salient angle and two guide wheel anchor blocks are provided at the lower ends of the two lateral surfaces of a plurality of said door panels, respectively, multiple diaphragms are provided in the inner chamber of a plurality of said door panels to form multiple chambers, wherein a surface of said V-shaped groove, a surface of said inverted V-shaped salient angle and a surface between said door panel and said frame can be stuck respectively with a waterproof glue strip, and a surface of the V-shaped groove pressed by said downward-pressing plate of the downward-pressing hydraulic cylinder can also be stuck with a sealing gasket.

In a preferred embodiment of the invention, the door plate fixation hole of a plurality of said door panels is inserted with a axis shaft drilling at said chain, the guide wheel anchor blocks of a plurality of said door panels are locked up with a guide wheel fixation plate, wherein one end of said axis shaft is sheathed with a bearing set, said guide wheel fixation plate is provided with a sheathed with a guide wheel.

In a preferred embodiment of the invention, an infrared detector is provided in the frames to detect an abnormal situation as the door plate approaches to the ground surface; or an infrared detector is mounted at the exterior of the roller shutter to detect an abnormal situation as any person, vehicle or object passes.

In a preferred embodiment of the invention, two stoppers are provided in the storage device to stop a plurality of said door panels, and an opening of said branch rail is provided with a guiding opening expanding outwards, and a fixation board and a chain guard board being installed above the overhead rail of the storage device, wherein the upper edge and the lower edge of the overhead rail are provided with a folding portion.

In a preferred embodiment of the invention, the downward-pressing hydraulic cylinder or the sideward-pressing hydraulic cylinder may be provided with one or more downward-pressing hydraulic cylinders, and/or provided with one or more sideward-pressing hydraulic cylinders as need.

In a preferred embodiment of the invention, the top of the reinforced column is provided movable across said guiding rod and guiding screw of the driving device, the bolt thereof may be driven by said vertical motor to be inserted into and fixed to a retaining base, which is provided at a track, and a ball is provided at the bottom thereof to stabilize the transverse movement of said reinforced column on the track, wherein said retaining base is provided with a cover plate and a spring.

In a preferred embodiment of the invention, said water level detector and said infrared detector perform sensing and detection by sending a signal to said automatic controller, said automatic controller may control open, close or movement of said flood protection roller shutter, downward-pressing hydraulic cylinder, sideward-pressing hydraulic cylinder and reinforced column according to said signal.

In another preferred embodiment of the invention, an automatically auto-sensing flood protection roller shutter with auto-locating reinforced column is provided, wherein the flood protection roller shutter includes a door plate, which is composed of a plurality of door panels, which may be disposed in between two frames or contained in one storage device; a casing, which is provided at the top of the door plate and is provided with a motor, a hydraulic pump, an automatic controller, an uninterruptible power system and a storage device in the interior thereof; two frames mounted on two sides of the door plate oppositely to dispose a plurality of said door panels; and a storage device, wherein at the left and right inner walls of which are provided respectively with one overhead rail in a horizontal direction thereof, one guide rail in a vertical direction, one end of each guide rail being bonded with one connecting branch rail, and a gear being provided at the shortest distance between each of the overhead rails and each of the guide rails, a chain being engaged with each of the gears, each of the chains may move along with each of the overhead rails and each of the guide rails.

In a further preferred embodiment of the invention, an automatically auto-sensing flood protection roller shutter with auto-locating reinforced column is provided, wherein the auto-locating reinforced column includes a reinforced column, which is provided behind a door plate to be driven for transverse movement by a first motor provided on the upper end thereon and a second motor provided in the driving device to move the reinforced column in a direction parallel to the door plate from a non-reinforcing position to a door plate reinforcing position, and said reinforced column having a bolt and a vertical motor provided in an inner chamber at the lower end thereof; and a driving device, which is provided at the lower portion in a casing, a fixation joint and a bearing set being provided at the two inner walls thereof, respectively, two ends of a guiding rod being fixed in said two fixation joints, respectively, one end of a guiding screw and one end of a transmission shaft being fixed in said two bearing sets, respectively, wherein the other end of said guiding screw and the other end of said transmission shaft are butted mutually, and the first reinforced column driving motor is provided at the upper end of the reinforced column, and the horizontal motor is provided in the driving device; thereby, once a flooding occurs, the automatically auto-sensing flood protection roller shutter may operate the water level detector activating the alarm value over the water level to transmit the signal to the automatic controller, the automatic controller activates the motors, vertical motors and horizontal motors to lower a plurality of the door panels one by one for the flood protection shutter to be self-packed, and moves transversely the reinforced column to the retaining base, the bolt of the reinforced column is pushed automatically into the retaining base to enhance the flood protection strength of the shutter, further, downward pressure and sideward pressure forces of the downward-pressing hydraulic cylinder and the sideward-pressing hydraulic cylinder are applied to secure a plurality of door panels, the ground surface and the reinforced column closely to achieve airtight waterproof, such that the functions and advantages of the automatically auto-sensing flood protection without manual operation may be accomplished.

BRIEF DESCRIPTION OF THE DRAWINGS

FIG. 7E-2 is a schematic view showing an enlarged appearance of FIG. 7E-1 according to the invention.

FIG. 7F-1 is a schematic view showing the appearance of a chain guard board of a storage device for the automatic auto-sensing flood protection roller shutter with auto-locating reinforced column according to the invention.

FIG. 7F-2 is a schematic view showing an enlarged appearance of FIG. 7F-1 according to the invention.

FIG. 7G-1 is a schematic view showing the appearance of a folding portion of an overhead rail of a storage device for the automatic auto-sensing flood protection roller shutter with auto-locating reinforced column according to the invention.

FIG. 7G-2 is a schematic view showing the appearance of FIG. 7G-1 from another angle.

DETAILED DESCRIPTION OF THE PREFERRED EMBODIMENT

For understanding comprehensively the purposes, features and advantages of the invention, the following embodiments in connection with appended drawings are described in detail below.

Figure 1A:
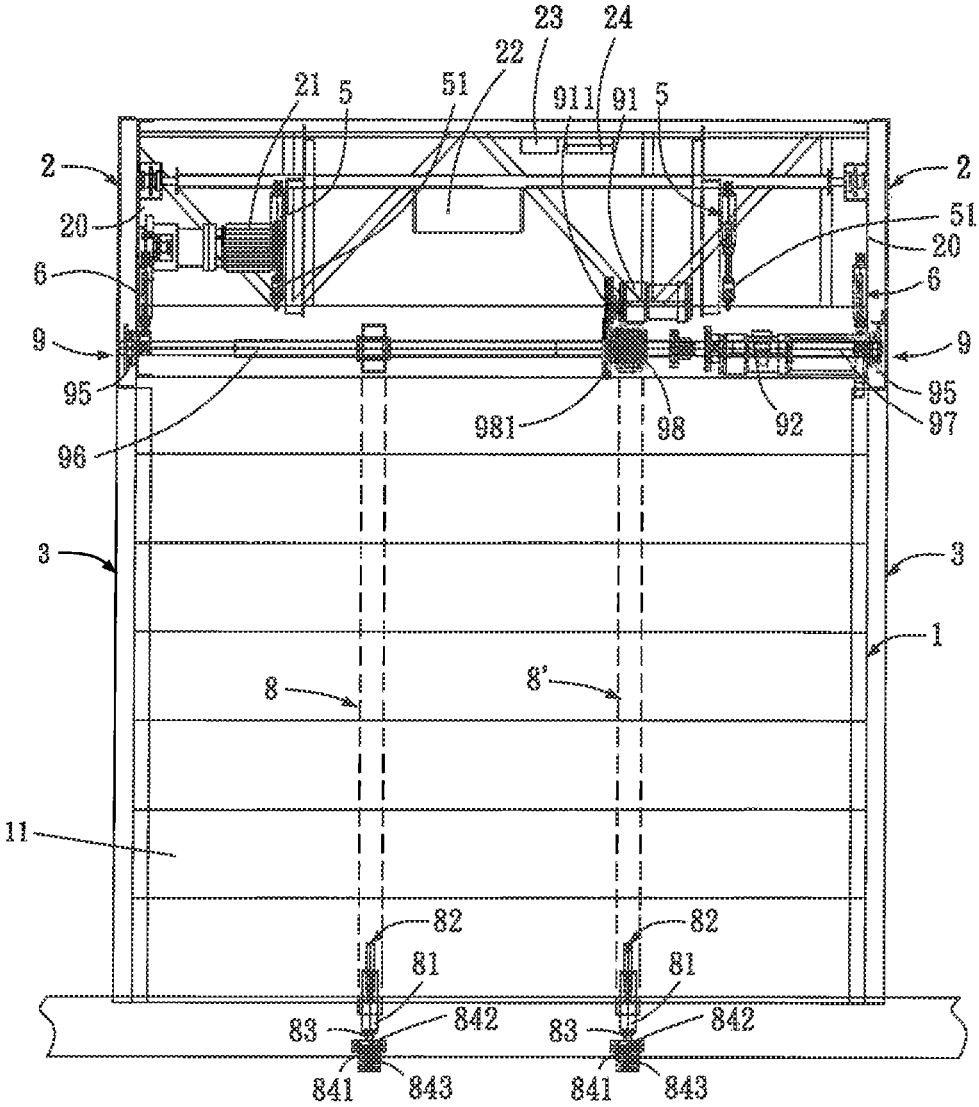
FIG. 1A is a front sectional view showing the automatic auto-sensing flood protection roller shutter with auto-locating reinforced column according to the invention.
Figure 1B:
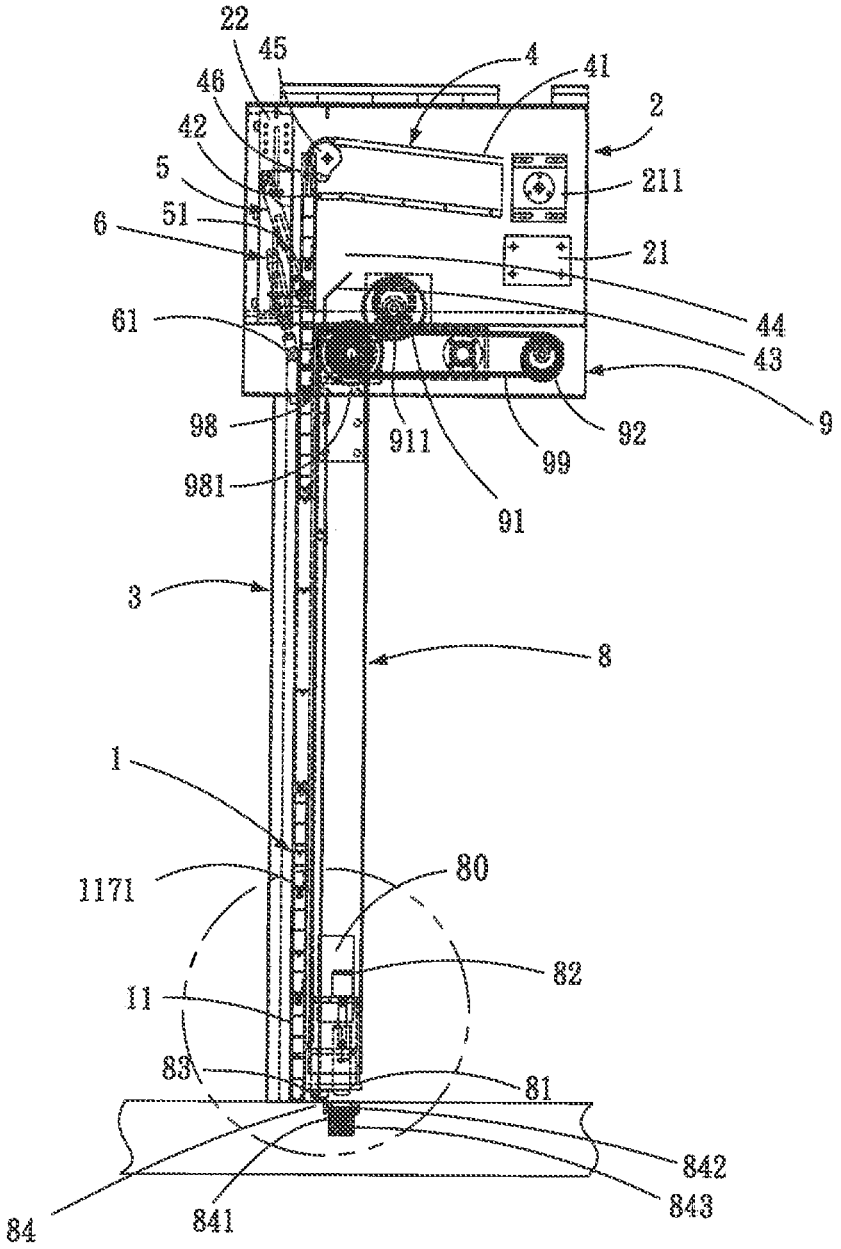
FIG. 1B is a lateral sectional view showing the automatic auto-sensing flood protection roller shutter with auto-locating reinforced column according to the invention.
Figure 2A:
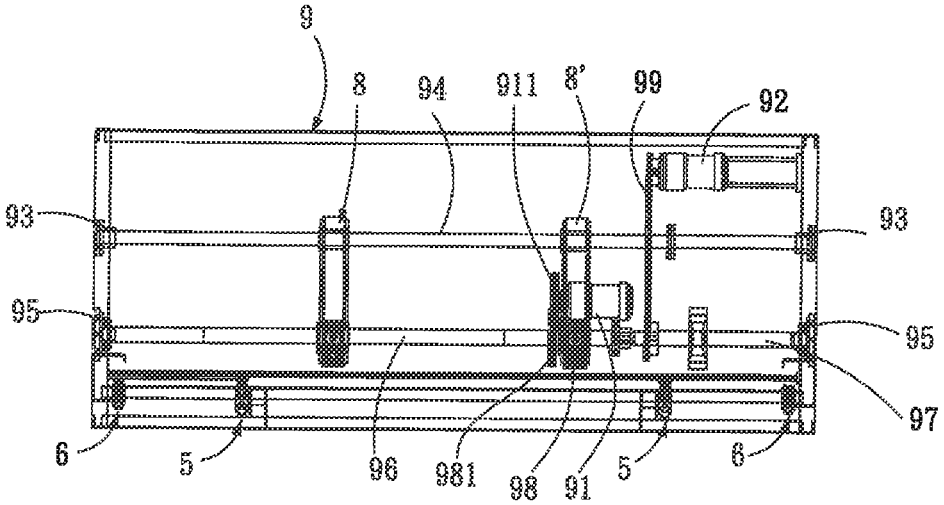
FIG. 2A is a top sectional view showing the driving device of the automatic auto-sensing flood protection roller shutter with auto-locating reinforced column according to the invention.
Figure 5A:
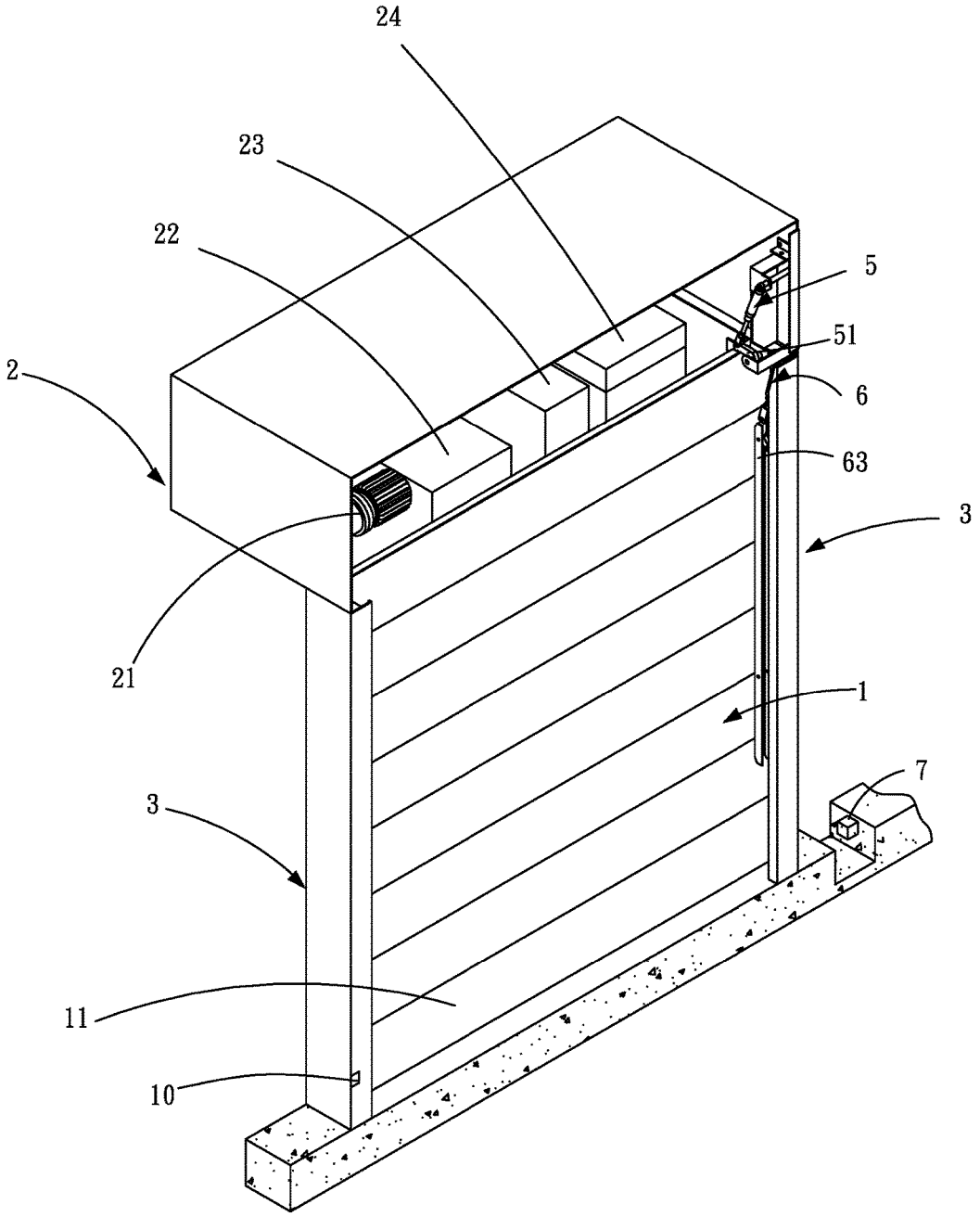
FIG. 5A is a solid appearance view showing the automatic auto-sensing flood protection roller shutter with the auto-locating reinforced column according to the invention.
Figure 7A:
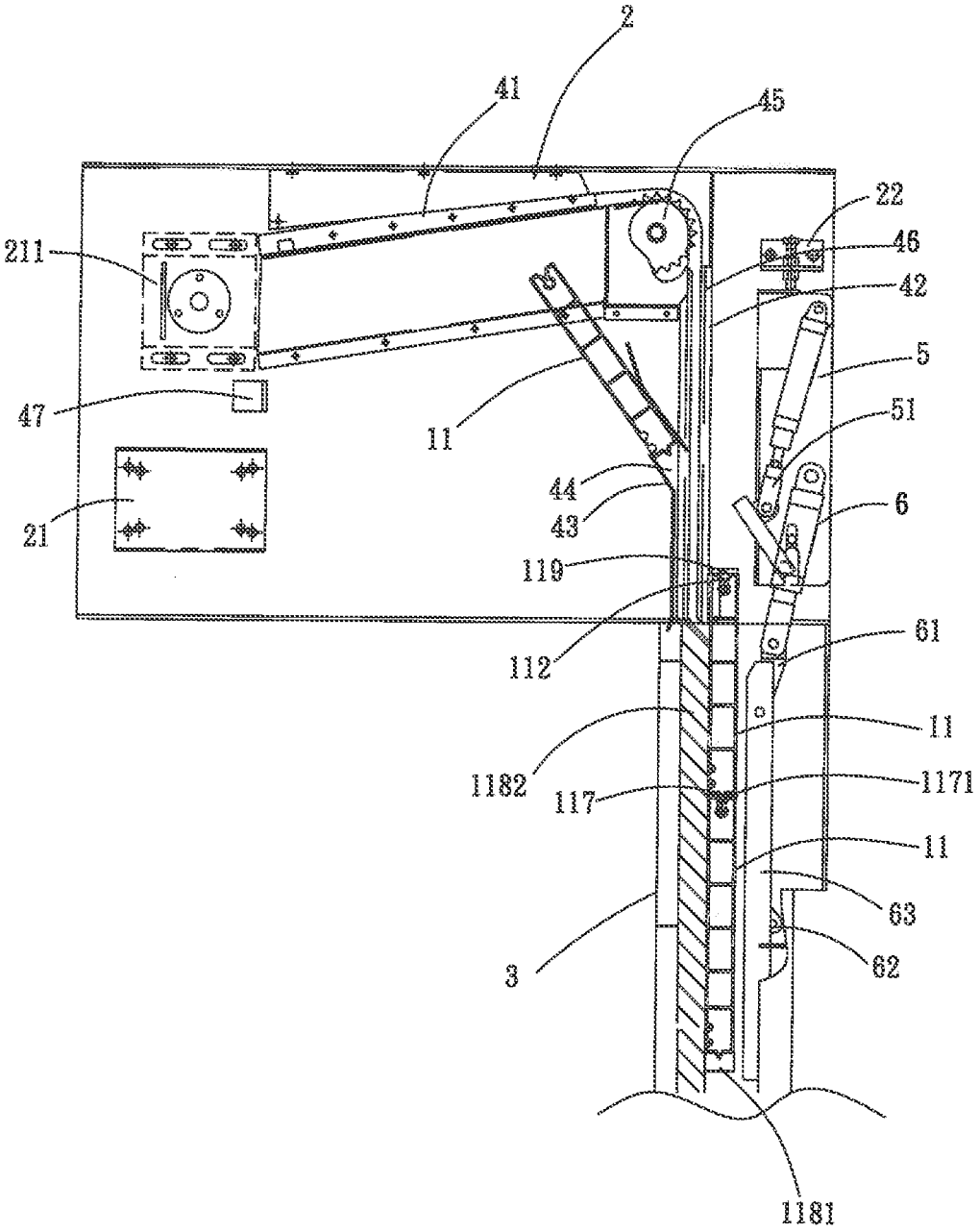
FIG. 7A is a first lateral operation view showing access of a plurality of door panels of the automatic auto-sensing flood protection roller shutter with auto-locating reinforced column to a casing according to the invention.
Figure 7B:
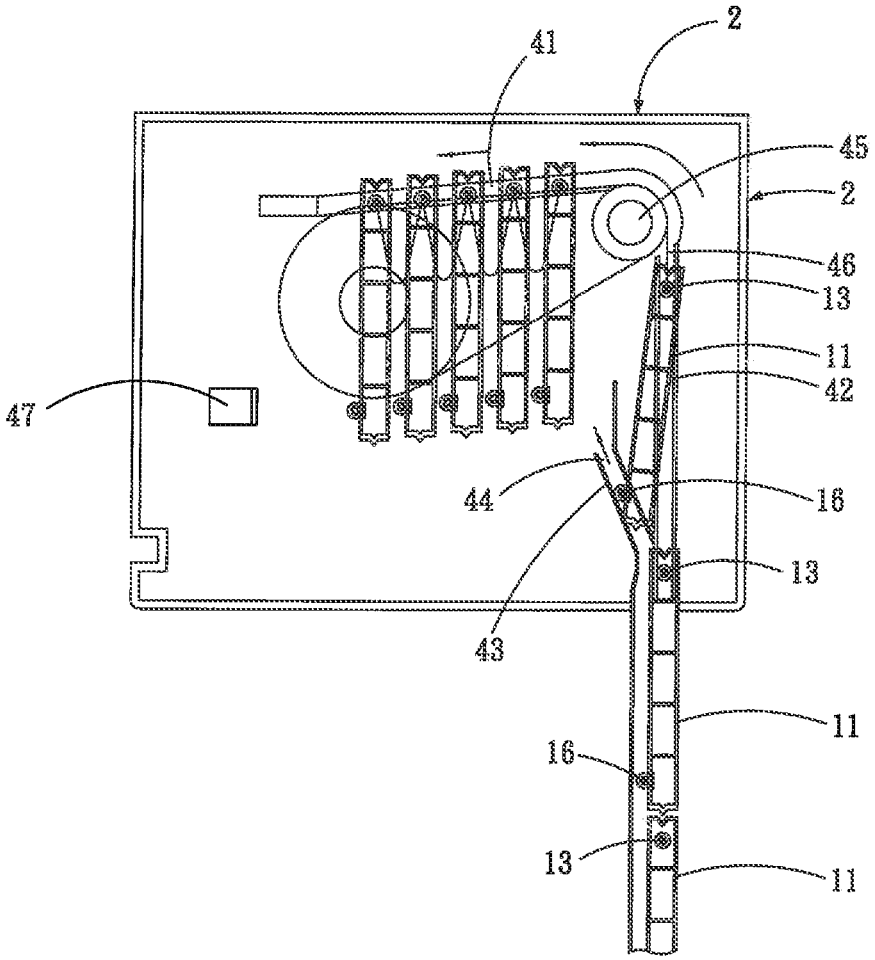
FIG. 7B is a second lateral operation view showing access of a plurality of door panels of the automatic auto-sensing flood protection roller shutter with auto-locating reinforced column to a casing according to the invention.
Figure 7C:
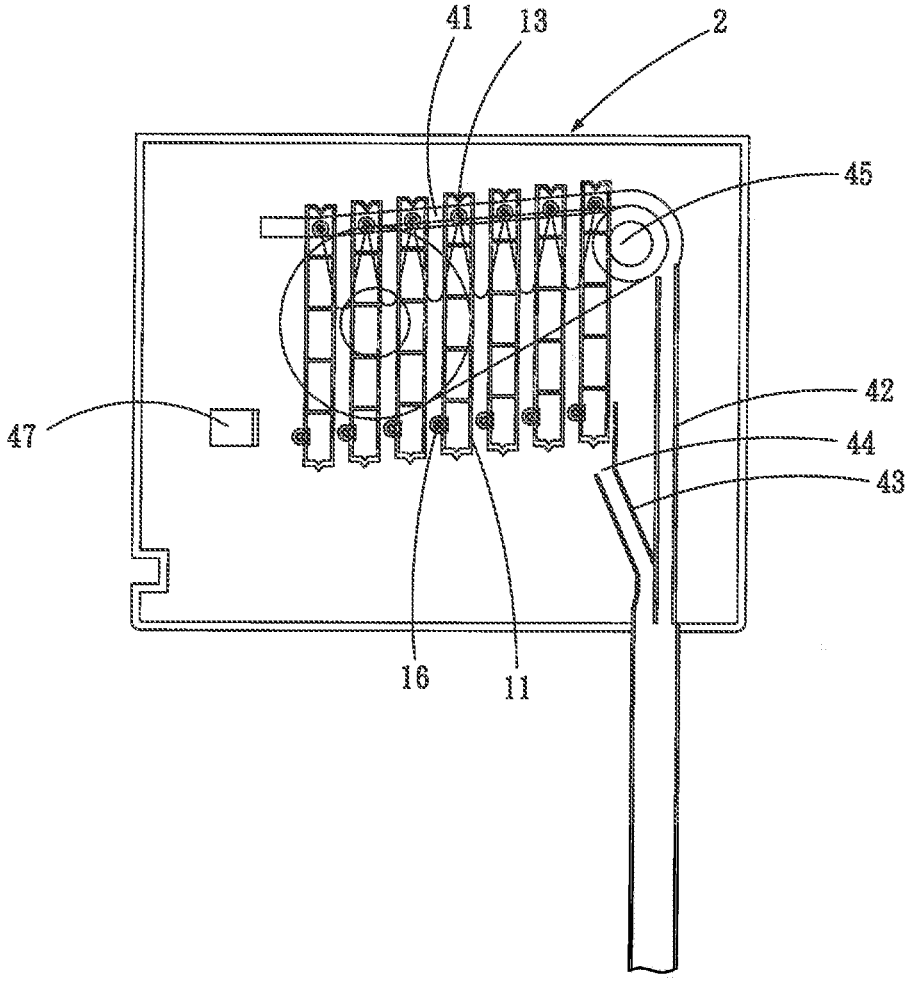
FIG. 7C is a third lateral operation view showing access of a plurality of door panels of the automatic auto-sensing flood protection roller shutter with auto-locating reinforced column to a casing according to the invention.
Figure 7D:
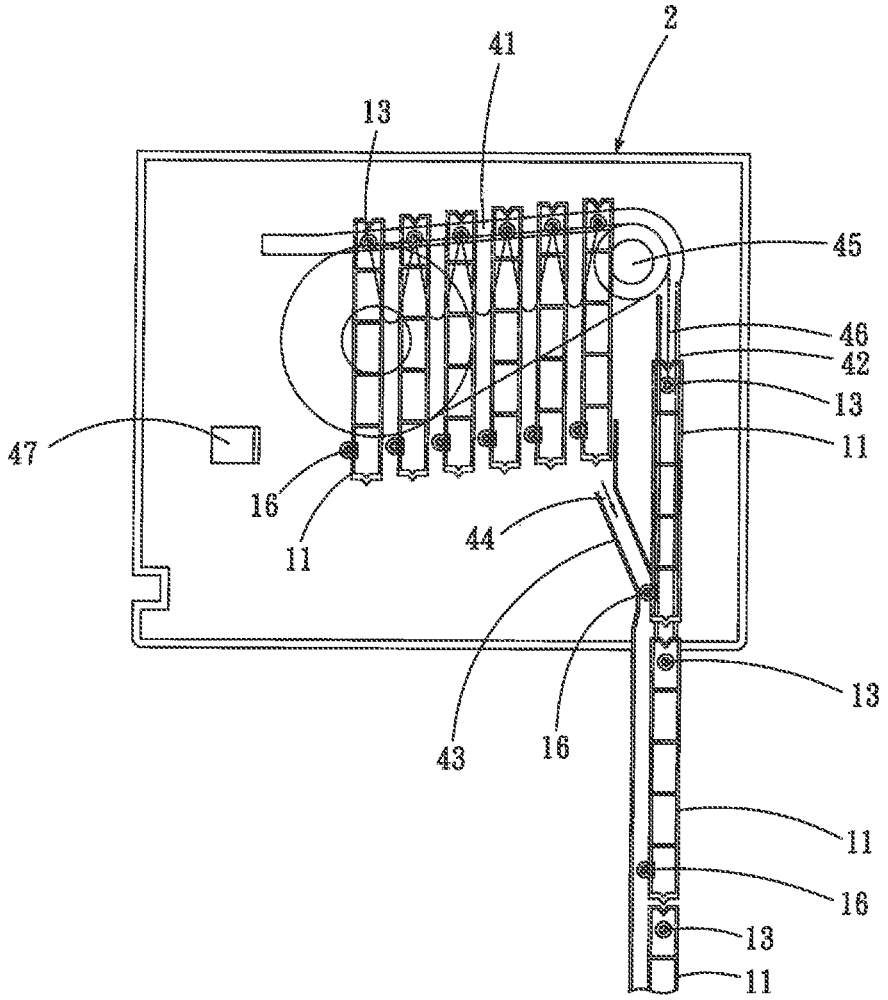
FIG. 7D is a fourth lateral operation view showing access of a plurality of door panels of the automatic auto-sensing flood protection roller shutter with auto-locating reinforced column to a casing according to the invention.
Figures 1, 7E:
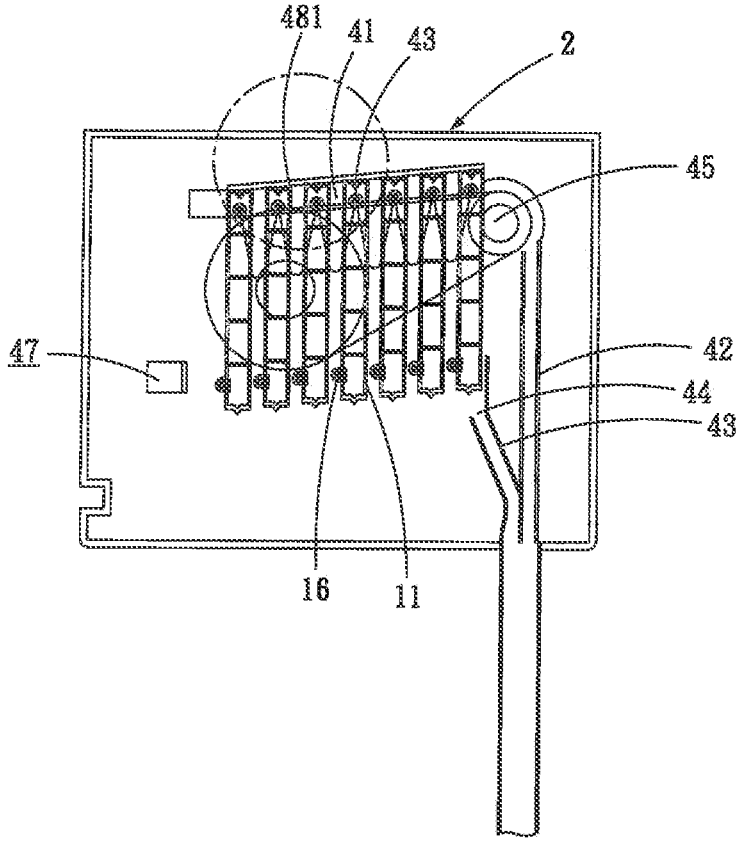
FIG. 7E-1 is a schematic view showing the appearance of a fixation board of a storage device for the automatic auto-sensing flood protection roller shutter with auto-locating reinforced column according to the invention.
Figures 2, 7E:
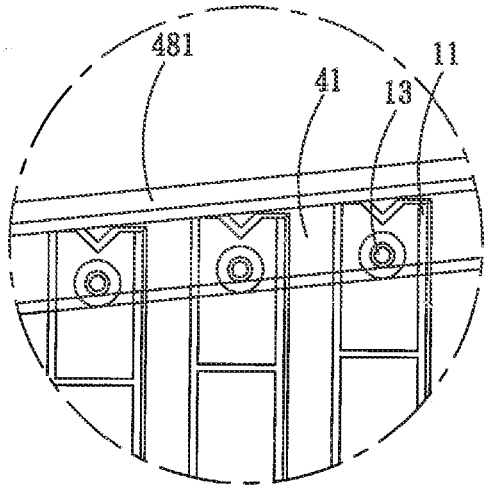
Figures 1, 7F:
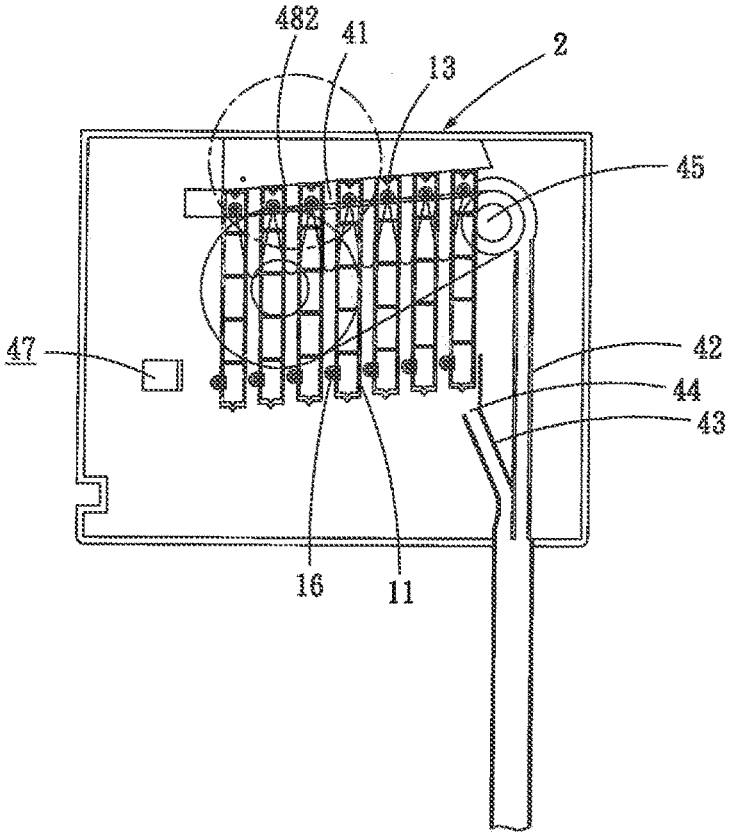
Figures 2, 7F:
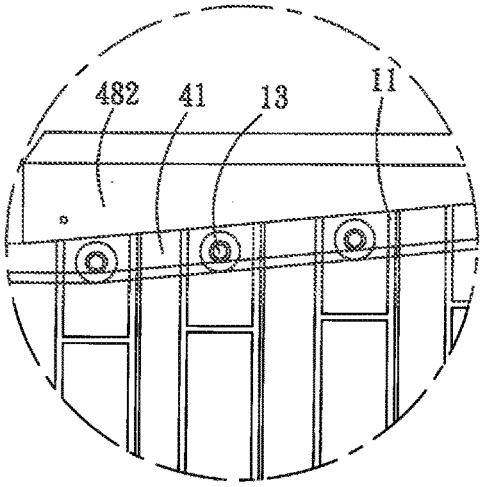

Refer to FIGS. 1A and 1B, which are a front sectional view and a lateral sectional view showing an automatic auto-sensing flood protection roller shutter with auto-locating reinforced column according to a preferred embodiment of the invention. As shown in the figures, the automatic auto-sensing flood protection roller shutter with auto-locating reinforced column according to the invention include a door plate 1, which is composed of a plurality of door panels 11, which may be disposed in between two frames 3 or contained in a storage device 4; a casing 2, which is provided on the top of the door plate 1 and the interior thereof is provided with a motor 21, a hydraulic pump 22 (as shown in FIG. 5A), an automatic controller 23 (as shown in FIG. 5A), an uninterruptible power system 24 (as shown in FIG. 5A), a downward-pressing hydraulic cylinder 5 and a driving device 9; two frames 3 mounted on two sides of the door plate 1 to dispose plurality of said door panels 11; a storage device 4, wherein on each of the left and right walls of which is provided respectively with an overhead rail 41 in a horizontal direction, brackets 211, and a guide rail 42 in a vertical direction, each of the guide rails 42 being bonded with a connecting branch rail 43 respectively, and a gear 45 being provided at the shortest distance between each of the overhead rails 41 and each of the guide rails 42, a chain 46 being engaged with each of the gears 45, each of the chains 46 may move along with each of the overhead rails 41 and each of the guide rails 42; a downward-pressing hydraulic cylinder 5, which is provided in said casing 2 or frame 3, a downward-pressing plate 51 being provided at the lower end thereof to press the door plate 1; a sideward-pressing hydraulic cylinder 6, which is provided in said frame 3, a push lever 61 being connected to the lower end thereof; a water level detector 7 (as shown in FIG. 5A), which is provided in underground space for a waterproof system to be turned on automatically once a certain water level is detected; a reinforced column 8, which is provided behind the door plate 1, a gear box 98 provided at an upper end of the reinforced column 8', a first reinforced column driving motor 91 provided at the top of the reinforced column 8' to rotate the transmission shaft 97 and drive the reinforced column 8' for transverse movement relative to the reinforced column 8 from a position (b) to a position (c) via a gear 981 of the gear box 98 as shown in FIGS. 1A and 1B, and a second reinforced column driving motor 92 provided in the driving device 9 to cause transverse movement of both the reinforced column 8 and the reinforced column 8' via the transmission shaft 97, guiding screw 96, sprocket gear 921, and chain 99 from an initial non-reinforcing position (a) to the position (b), and the inner chamber 80 at the lower end of the reinforced column 8 being provided with a bolt 81 and a vertical motor 82; and a driving device 9, which is provided at the lower portion in the casing 2, a fixation joint 93 and a bearing set 95 being provided at each of the two inner walls thereof, the two ends of a guiding rod 94 being fixed respectively in said two fixation joints 93 (as shown in FIG. 2A-1,2A-2), one end of the guiding screw 96 and one end of the transmission shaft 97 being fixed in each of said two bearing sets 95, wherein the other end of said guiding screw 96 and the other end of said transmission shaft 97 are butted mutually. Moreover, one or more downward-pressing hydraulic cylinder 5 may be arranged in a casing 2 or frame 3 symmetrically or asymmetrically. Refer to FIG. 2A, which is a top sectional view showing an automatic auto-sensing flood protection roller shutter with auto-locating reinforced column according to a preferred embodiment of the invention. As shown in the figure, first reinforced column driving motor 91 is installed at the top of the reinforced column 8' to actuate the gear box 98 at the upper end of the reinforced column 8'. The second reinforced column driving motor 92 actuates the transmission shaft 97 to interact with the first motor 91, and cause a gear of the gear box 98 to engage with a gear actuated by the first motor 91 to drive both the reinforced column 8 and the reinforced column 8' for transverse movement in a direction parallel to the door plate 1 across said guiding rod 94 and guiding screw 96 of the driving device 9 from a first non-reinforcing position (a) to a door plate reinforcing position (b), after which the first motor 91 drives the reinforced column 8' for transverse movement relative to the reinforced column 8 to the final reinforcing position (c), and the two inner walls of the driving device 9 are provided respectively with a fixation joint 93 and a bearing set 95, the two ends of a guiding rod 94 are fixed in said two fixation joints 93, respectively, one end of a guiding screw 96 and one end of a transmission shaft 97 are fixed in said two bearing sets 95, wherein the other end of said guiding screw 96 and the other end of said transmission shaft 97 are butted mutually.

Referring to FIG. 2A, which is a top sectional view showing an automatic auto-sensing flood protection roller shutter with auto-locating reinforced column according to a preferred embodiment of the invention. As shown in the figure and mentioned above, first motor 91 is installed at the top of the reinforced column 8' and movable with the reinforced column 8 to actuate the gear box 98 at the upper end of the reinforced column 8'. The second motor can actuate a transmission shaft 97 to interact with the first motor 91, and cause a gear of the gear box 98 to engage with a gear actuated by the first motor 91 to drive the reinforced column 8' for transverse movement relative to the reinforced column 8 from position (b) to position (c) after the two reinforced columns 8 and 8' have been moved from initial position (a) to position (b) by the second motor 92 via the transmission shaft 97 across said guiding rod 94 and guiding screw 96 of the driving device 9, and the two inner walls of the driving device 9 are provided respectively with a fixation joint 93 and a bearing set 95, the two ends of a guiding rod 94 are fixed in said two fixation joints 93, respectively, one end of a guiding screw 96 and one end of a transmission shaft 97 are fixed in said two bearing sets 95, wherein the other end of said guiding screw 96 and the other end of said transmission shaft 97 are butted mutually.

Figure 2B:
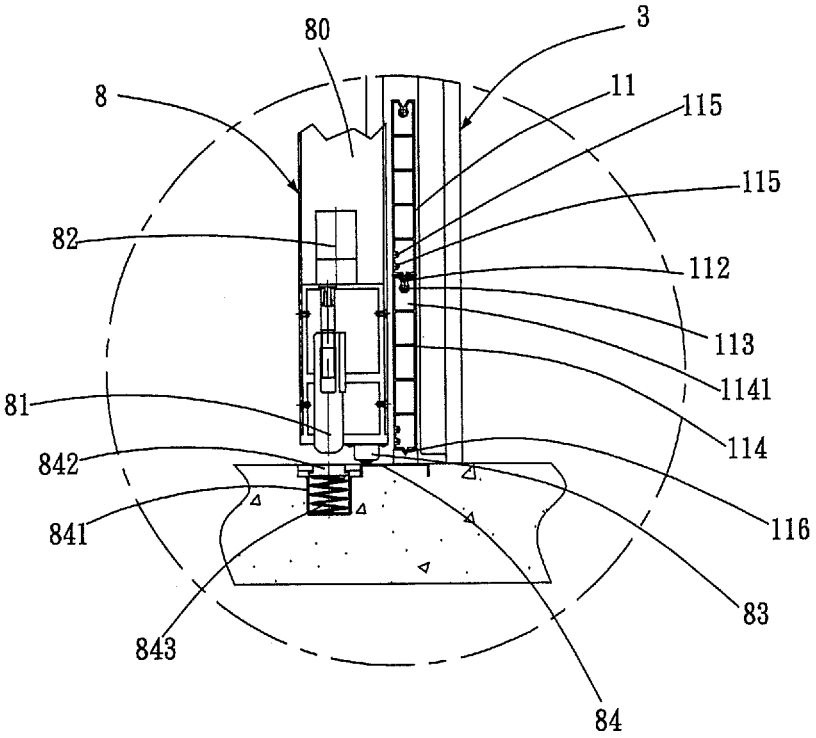
FIG. 2B is an enlarged sectional lateral view of FIG. 1B according to the invention.
Figure 3A:
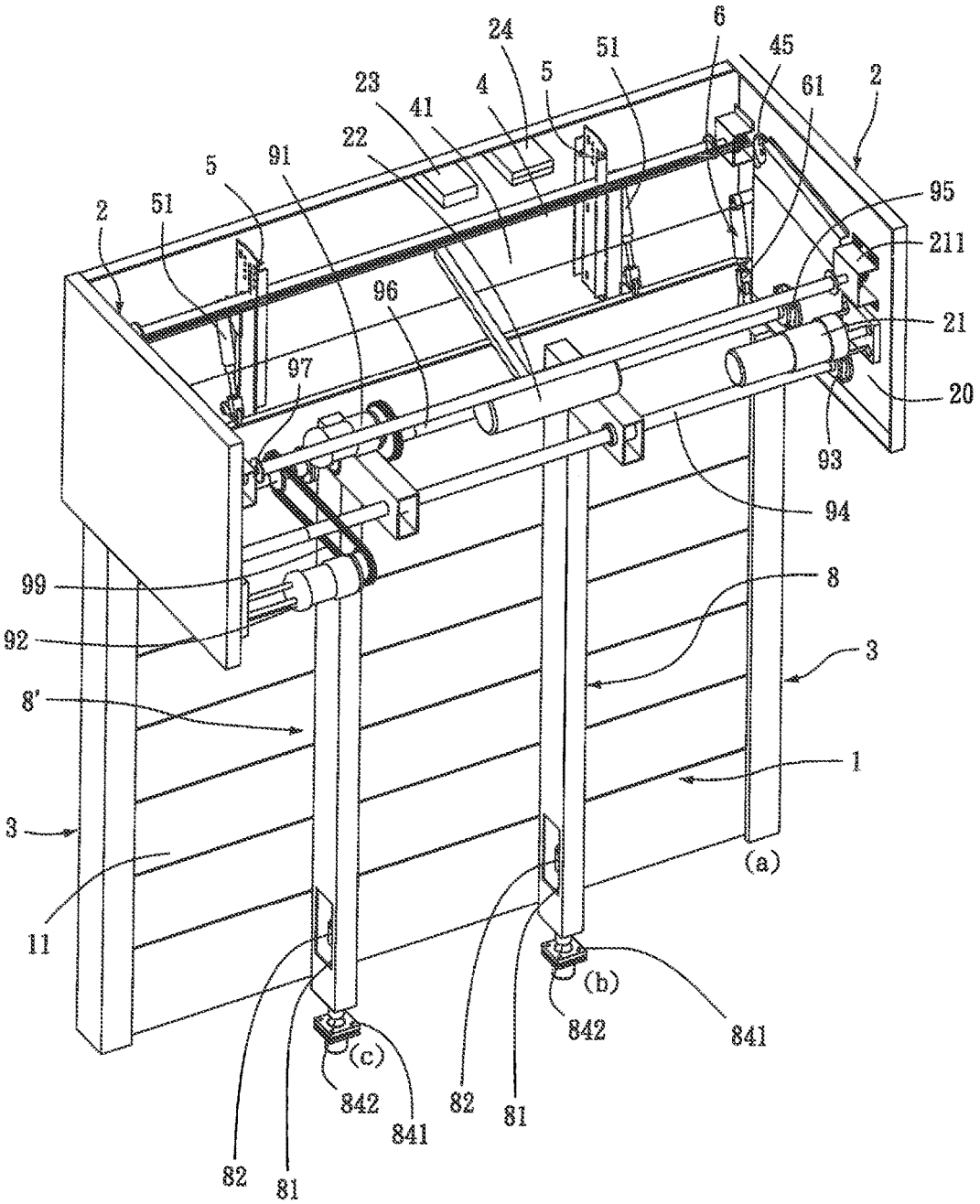
FIGS. 3A and 3B are solid schematic view showing the automatic auto-sensing flood protection roller shutter with auto-locating reinforced column according to the invention.
Figure 3B:
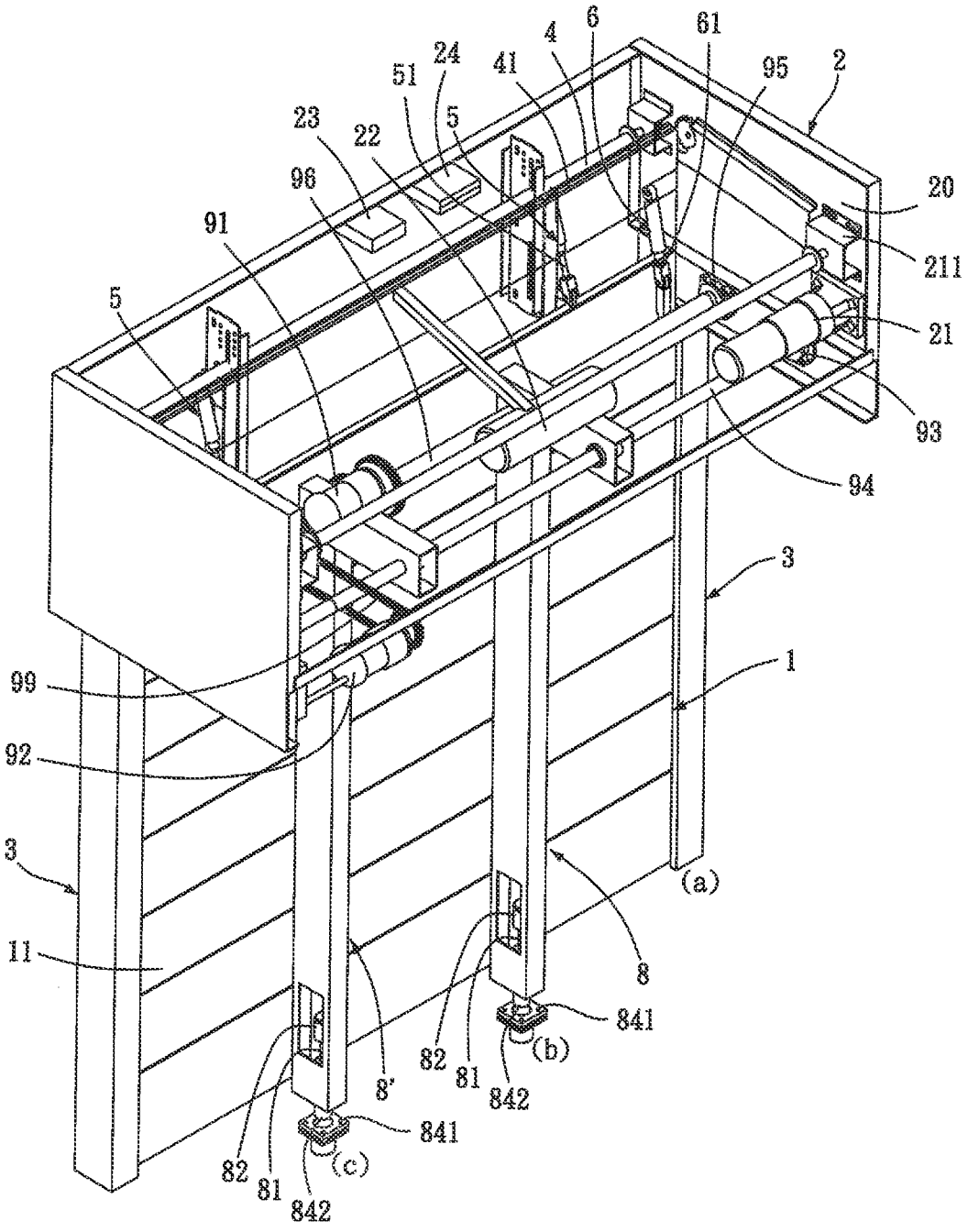

Refer to FIG. 3, which is a solid schematic view showing the automatic auto-sensing flood protection roller shutter with auto-locating reinforced column according to the invention. As shown in the figure, said reinforced column 8 is provided behind the door plate 1, an user may dispose one or multiple reinforced columns 8 behind the door plate 1 to meet a special width requirement of the roller shutter, further, said reinforced column 8 is an inverted L shape, and the top thereof is drilled by the guiding rod 94 and the guiding screw 96 and the bottom thereof is provided with a ball 83 on the track 84 (as shown in FIG. 2B), such that the reinforced column 8 is stabilized with respect to transverse movement behind the door plate 1 and the rocking resulting from the transverse movement of the reinforced column 8 is reduced to achieve the advantage for movement guiding stabilization of said reinforced column 8. Further, the reinforce column 8 also facilitates to reduce the deformation of a plurality of door panels 11 due to flood or water pressure such that the advantage for enhancement of waterproof and flood protection capabilities may be achieved.

Figure 4:
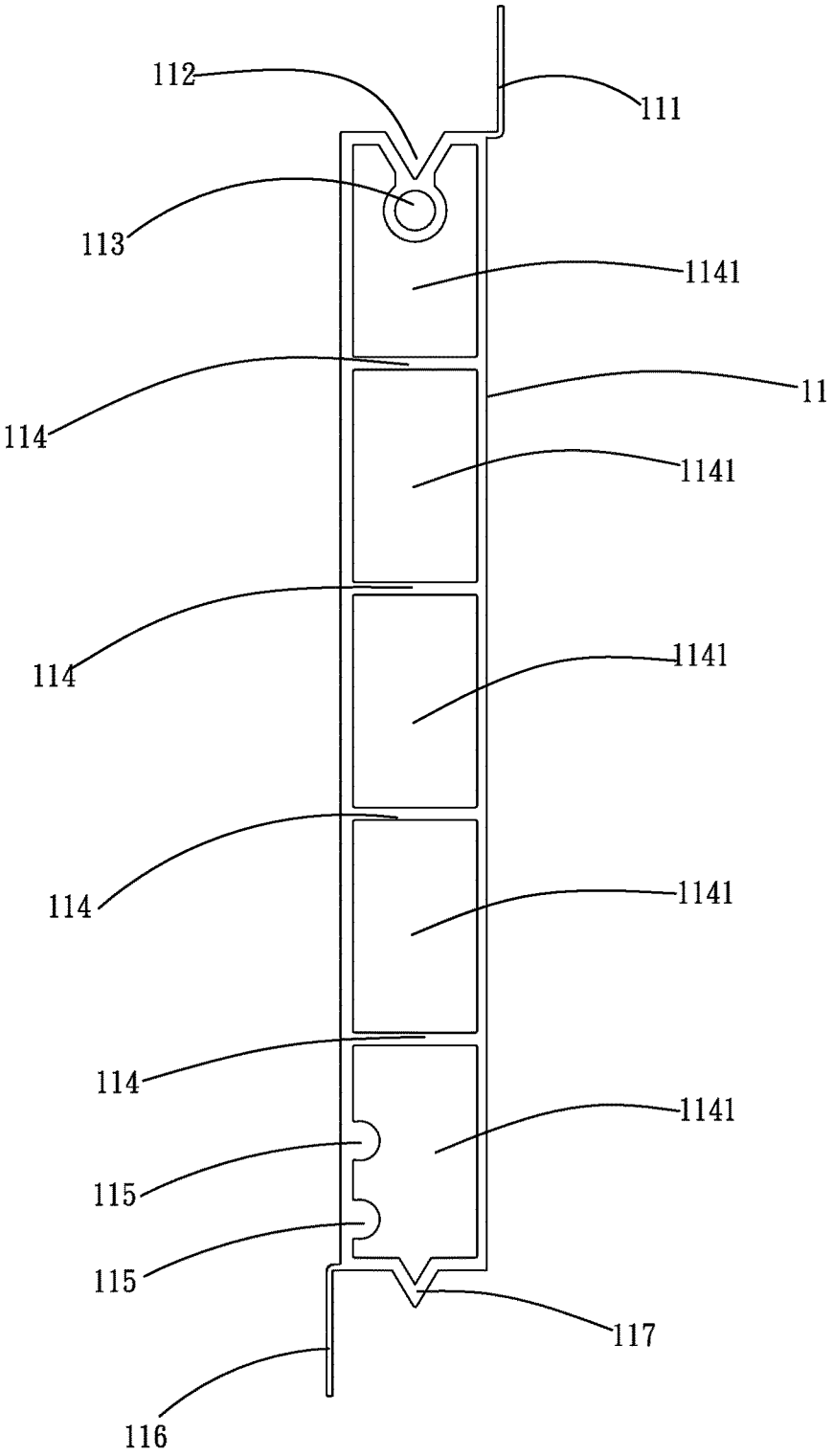
FIG. 4 is a lateral sectional view of the door panel of the automatic auto-sensing flood protection roller shutter with auto-locating reinforced column according to the invention.

Refer to FIG. 4, which is a lateral sectional view showing a plurality of door panels of the automatic auto-sensing flood protection roller shutter with auto-locating reinforced column according to the invention. As shown in the figure, a hand clamping prevention block piece 111, a V-shaped groove 112 and a door plate fixation hole 113 are provided at the upper ends of the two lateral surfaces of a plurality of said door panels 11 of the door plate 1 (as shown in FIG. 1A), respectively, a hand clamping prevention block piece 111, an inverted V-shaped salient angle 116 and at least one guide wheel anchor block 115 are provided at the lower ends of the two lateral surfaces of a plurality of said door panels 11, respectively, multiple diaphragms 114 are provided in the inner chamber of a plurality of said door panels to form multiple chambers 1141, wherein the surfaces of said V-shaped groove 117 and said inverted V-shaped salient angle 116 are stuck with waterproof glue strips 1171 (as shown in FIG. 7A) separately, the surfaces between a plurality of said door panels 11 and said frames 3 (as shown in FIG. 1A) are stuck with waterproof glue strips 1182 (as shown in FIG. 7A), the surface of the V-shaped groove 112 pressed by the downward-pressing plate 51 of the downward-pressing hydraulic cylinder 5 may also be stuck with a sealing gasket 119 (as shown in FIG. 7A), and the surface of the lowest door panel is stuck with waterproof glue strip 1181, wherein the advantage for strength enhancement of a plurality of door panels 11 may be achieved by the design of the diaphragms 114 of a plurality of door panels 11.

Figure 5B:
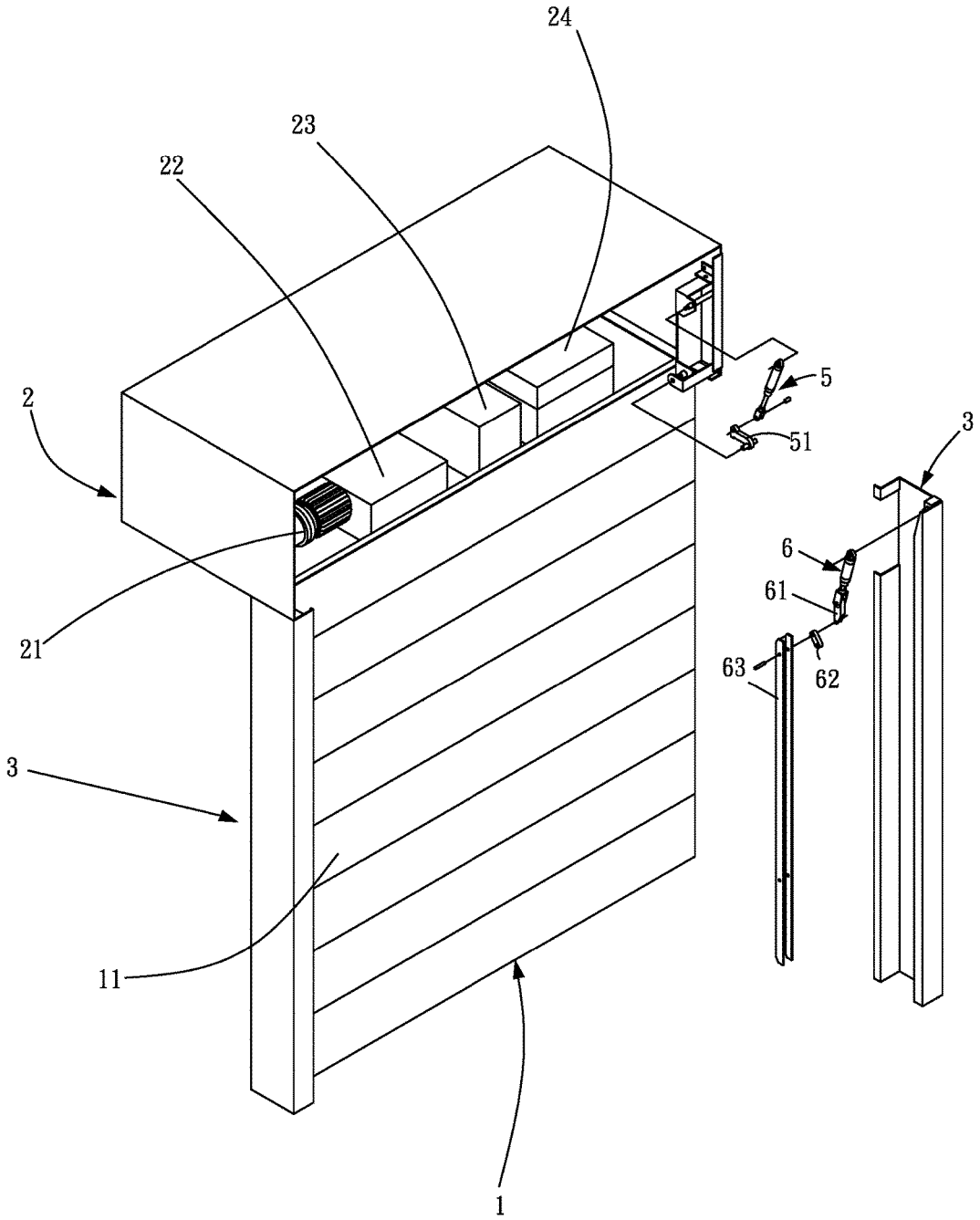
FIG. 5B is a solid appearance decomposition view showing the automatic auto-sensing flood protection roller shutter with auto-locating reinforced column according to the invention.
Figure 5C:
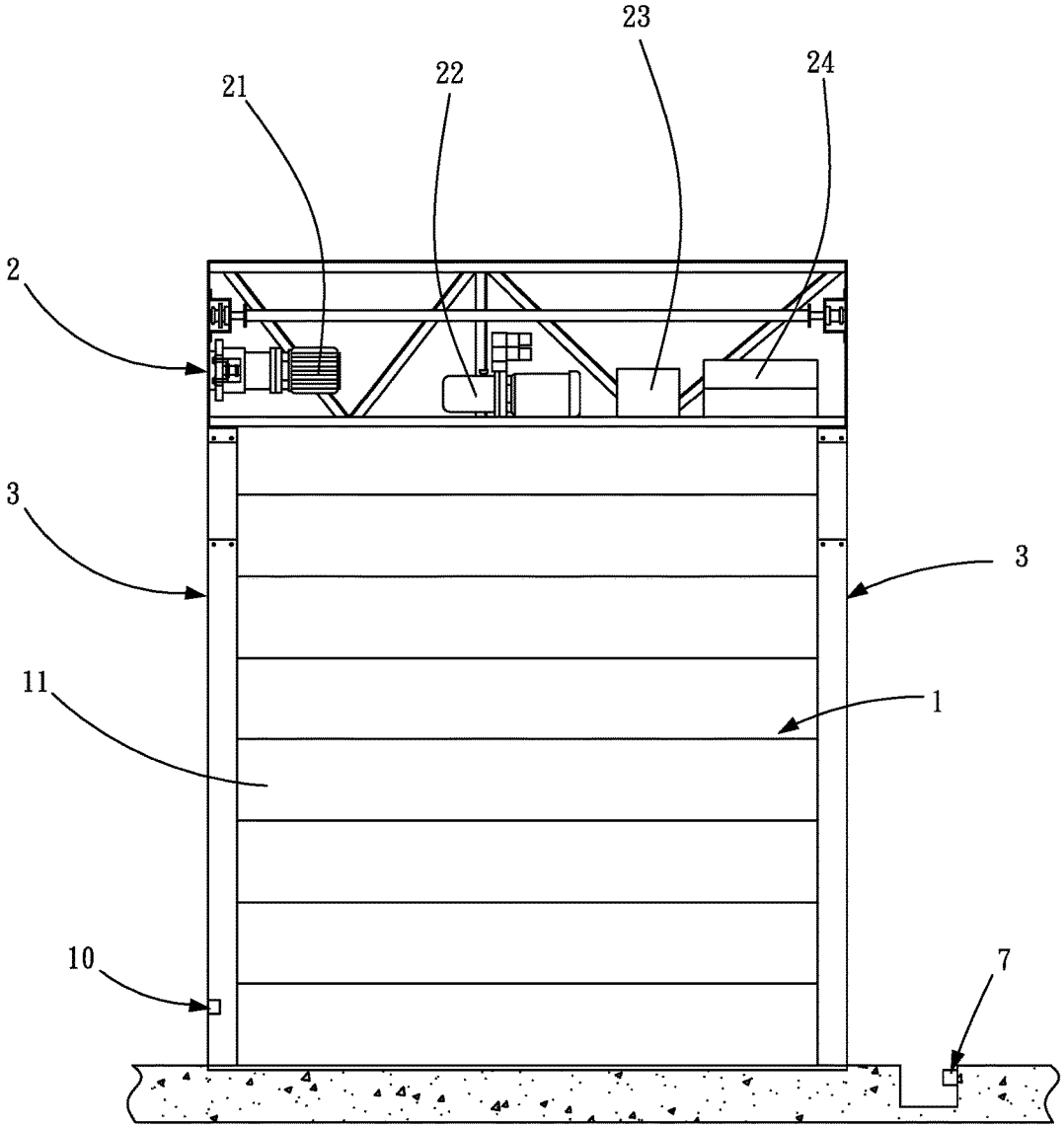
FIG. 5C is a flat frontal view showing the automatic auto-sensing flood protection roller shutter with auto-locating reinforced column according to the invention.
Figure 6A:
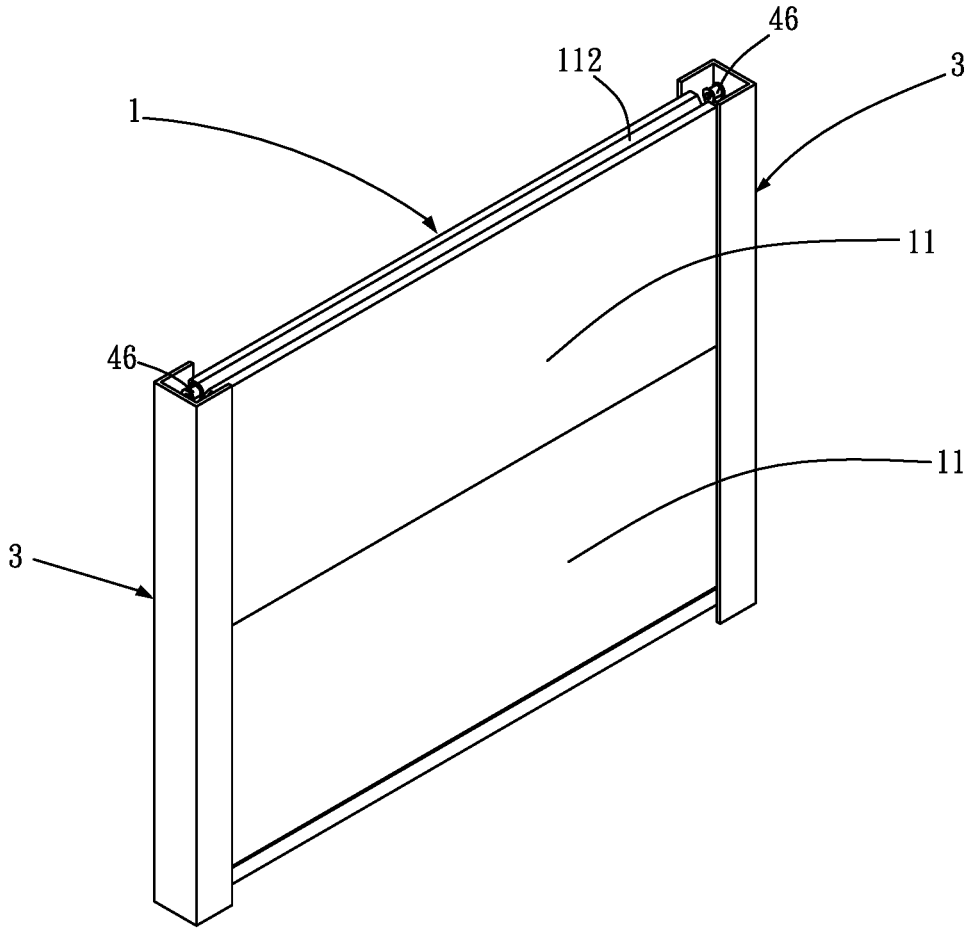
FIG. 6A is a solid appearance view showing door plate of the automatic auto-sensing flood protection roller shutter with the auto-locating reinforced column according to the invention.
Figure 6B:
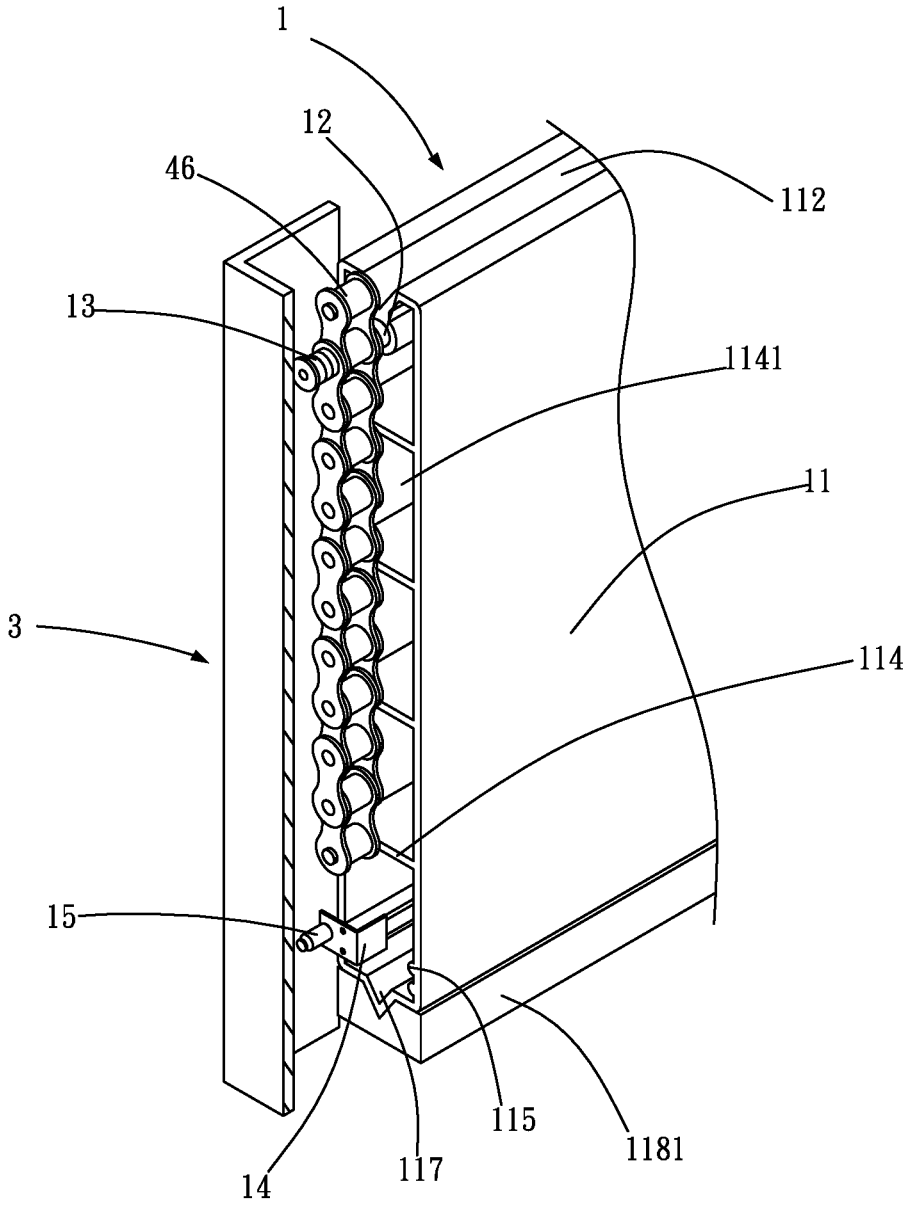
FIG. 6B is a solid combination schematic view showing the door plate of the automatic auto-sensing flood protection roller shutter with auto-locating reinforced column according to the invention.
Figure 6C:
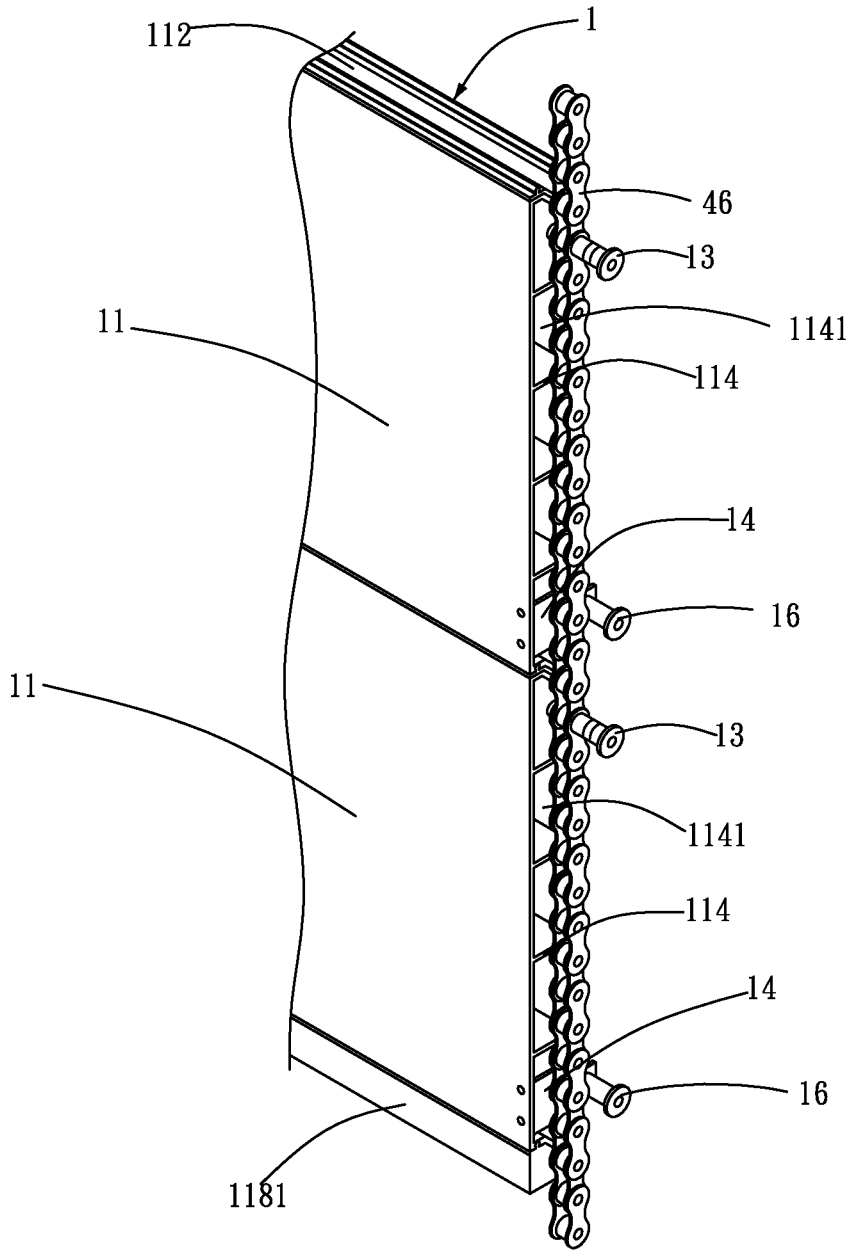
FIG. 6C is a solid combination schematic view from another lateral viewing angle showing the door plate of the automatic auto-sensing flood protection roller shutter with auto-locating reinforced column according to the invention.
Figure 6D:
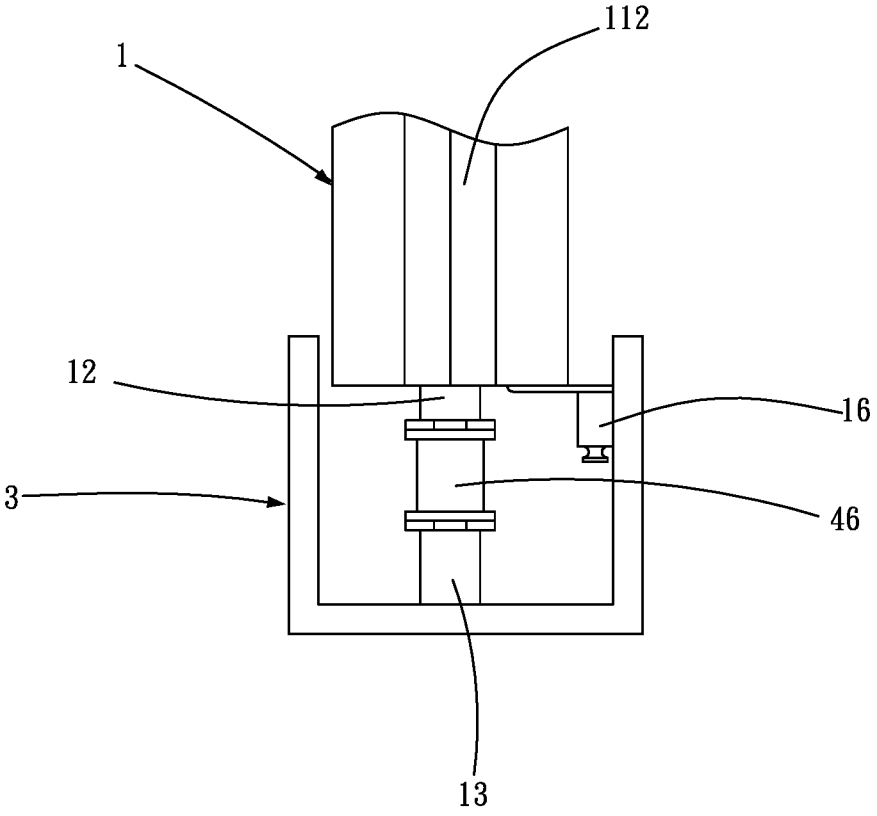
FIG. 6D is a flat combination schematic view from the top viewing angle showing the door plate of the automatic auto-sensing flood protection roller shutter with auto-locating reinforced column according to the invention.

Refer to FIGS. 5A, 5B, 5C, which are solid appearance views of FIG. 1B showing the automatic auto-sensing flood protection roller shutter with auto-locating reinforced column according to a preferred embodiment of the invention. As shown in the figure, an infrared detector 10 is provided at side-frames 3 to detect abnormal situation as the door plate 1 approaches to the ground surface, the downward-pressing hydraulic cylinder 5 or the sideward-pressing hydraulic cylinder 6 may be provided with one or more downward-pressing hydraulic cylinders 5, and/or provided with one or more sideward-pressing hydraulic cylinders 6, said water level detector 7 and said infrared detector 10 perform sensing and detection by sending a signal to said automatic controller 23, said automatic controller 23 may control open, close or movement of said flood protection roller shutter, downward-pressing hydraulic cylinder 5, sideward-pressing hydraulic cylinder 6 and reinforced column 8 according to said signal; or an infrared detector 10 is mounted at the exterior of the roller shutter to detect abnormal situations as any person, vehicle or object passes, as the infrared detector 10 detects an abnormal situation, said signal is sent to the automatic controller 23 synchronously, said automatic controller 23 stops lowering said flood protection roller shutter immediately to form a safety protection mechanism.

Further, after flooding, said water level detector 7 detecting a certain water level sends the signal to the automatic controller 23, the automatic controller 23 activates said motor 21, a first reinforced column driving motor 91 and second reinforced column driving motor 92, and moreover, the ball 83 for the reinforced column 8 to slide on the track 84 is provided to guide the transverse movement of the reinforced column 8 to the retaining base 841, the vertical motor 82 of the reinforced column 8 is activated to push the bolt 81 into a recess 842 and cushioning material 843 provided in the retaining base 841 for fixation, a plurality of door panels 11 are further lowered and pushed horizontally for layers to be aligned and fit for the downward-pressing hydraulic cylinder 5 to press downwards and make the downward-pressing plate 51 to press a plurality of door panels 11 with sealing gasket 118 disposed between each panel downwards to be waterproof, subsequently, the sideward-pressing hydraulic cylinder 6 presses downwards to drive the push lever 61 to induce the stop lever 62 to lower, as the stop lever 62 is lowered to a horizontal angle, the pressing plate 63 is stopped to push a plurality of door panels 11 horizontally for the waterproof glue strip 1172 to get more tight and fit therewith such that the advantage of improving airtight and waterproof and disaster prevention may be achieved.

In continuation, after the automatic controller 23 activates said motor 21, first reinforced column driving motor 91 and second reinforced column driving motor 92, a plurality of door panels 11 of the door plate 1 can also be lowered at first and pushed horizontally for the layers to be aligned and fit, for the downward-pressing hydraulic cylinder 5 to press downwards for the downward-pressing plate 51 to press a plurality of door panels 11 downwards to get waterproof, subsequently, the sideward-pressing hydraulic cylinder 6 presses downwards to drive the push lever 61 to induce the stop lever 62 to lower, as the stop lever 62 is lowered to a horizontal angle, the pressing plate 63 is stopped to push a plurality of door panels 11 horizontally, followed by providing the ball 83 of said reinforced column 8 sliding on the track 84 to guide the reinforced column 8 to move transversely to the retaining base 841, the vertical motor 82 of the reinforced column 8 is activated to push the bolt 81 into the retaining base 841 for fixation to complete the procedure of waterproof and flood protection.

On the contrary, after the flooding alert is released, said water level detector 7 sends again the signal to the automatic controller 23, the automatic controller 23 may provide at first the vertical motor 82 of the reinforced column 8 to retract the bolt 81 from the retaining base 841, after that, the ball 83 thereof sliding on the track 84 is provided to guide the reinforced column 8 to move transversely back to the original position, followed by recover the positions of the downward-pressing hydraulic cylinder 5 and the sideward-pressing hydraulic cylinder 6, a plurality of door panels 11 are withdrawn in the storage device 4; or, the automatic controller 23 recovers the positions of the downward-pressing hydraulic cylinder 5 and the sideward-pressing hydraulic cylinder 6, a plurality of door panels 11 are withdrawn in the storage device 4, followed by providing the vertical motor 82 of the reinforced column 8 to withdraw the bolt 81 from the retaining base 841, after that, the ball 83 thereof sliding on the track 84 is adapted to guide the reinforced column 8 move transversely back to the original position to complete the recovery procedure of the automatically auto-sensing flood protection roller shutter with auto-locating reinforced column 8. Therefore, with the sensing and detection of the above water level detector 7 and the infrared detector 10 and the signal control of the automatic controller 23, the advantage for operation of the automatic auto-sensing flood protection roller shutter and auto-locating of the reinforced column 8 is achieved.

Refer to FIGS. 6A, 6B, 6C and 6D, which are a solid appearance view, a solid combination schematic view, a solid combination schematic view from another lateral viewing angle and a plan combination schematic view from the top viewing angle showing the automatic auto-sensing flood protection roller shutter with auto-locating reinforced column according to a preferred embodiment of the invention. As shown in the figures, a door plate fixation hole 113 of said door leave 11 (as shown in FIG. 4) is inserted with one end of a first axis shaft 12, the other end of which drills said chain 46 and sheathes a bearing set 13; the guide wheel anchor block 115 of said door panels 11 is locked up with a guide wheel fixation plate 14, which is sheathed with a guide wheel 15.

Refer to FIGS. 7A, 7B, 7C and 7D, which are a first, a second, a third and a fourth lateral operation views showing access of a plurality of door panels of the automatic auto-sensing flood protection roller shutter with auto-locating reinforced column to a casing. As shown in the figures, the opening of said branch rail 43 is provided with a guiding opening 44 expanding outwards, as a plurality of door panels 11 desired to be overlapped in a line to form a waterproof shutter are folded in the storage device 4 of the casing 2, the gear 45 may be driven by the motor 21 to rotate at first for the chain 46 to move towards the storage device 4 under the driving of the gear 45, such that a plurality of door panels 11 overlapped originally may move along with the guide rail 42 sequentially towards the storage device 4 as the chain 46 contained in the guide rail 42 moves, while at the same time the bearing set 13 of one end of a plurality of door panels 11 connected pivotally to the chain 46 moves as the chain 46 moves, as one end, having the guide wheel 15, of a plurality of door panels 11 moves to the intersection formed by connecting the branch rail 43 and the guide rail 42, it may be diverged by a projection at the intersection to move along with the branch rail 43 towards the storage device 4, such that a plurality of said door panels 11 may be separated actually as the gear 45 moves towards the overhead rail 41, and the inclination of the overhead rail 41 may be used for the bearing set 13 to moves towards the overhead rail 41 smoothly and suspended on the overhead rail 41 to complete that the storage device 4 disposes and folds a plurality of door panels 11 automatically to achieve the advantages of convenient containment and facilitate to use.

On the contrary, as a plurality of door panels 11 in the casing 2 are desired to move external to the storage device 4, the motor 21 may be used to drive the gear 45 to rotate at first for the chain 46 to move sequentially from the overhead rail 41 to the guide rail 42 under the driving of the gear 45, such that a plurality of door panels 11 aligned together originally moves external to the storage device 4 sequentially along with the guide rail 42 as the chain 46 in the guide rail 42 moves, while at the same time the bearing set 13 of a plurality of said door panels 11 moves as the chain 46, the guiding of the guide wheel 15 at the guiding opening 44 is adapted further to move downwards in the branch rail 43, for a plurality of said door panels to be in an overlapping shape under the driving of the guide rail 42 and the chain 46, such that a plurality of door panels 11 are disposed in the frames 3 to form a waterproof shutter. Therefore, with the design of above bearing set 13, guide rail 42 and branch rail 43, the rocking and inclined movement may be avoided as a plurality of door panels are raised and lowered to achieve the advantages for stable movement and reduction of equipment damage.

Figures 1, 7G:
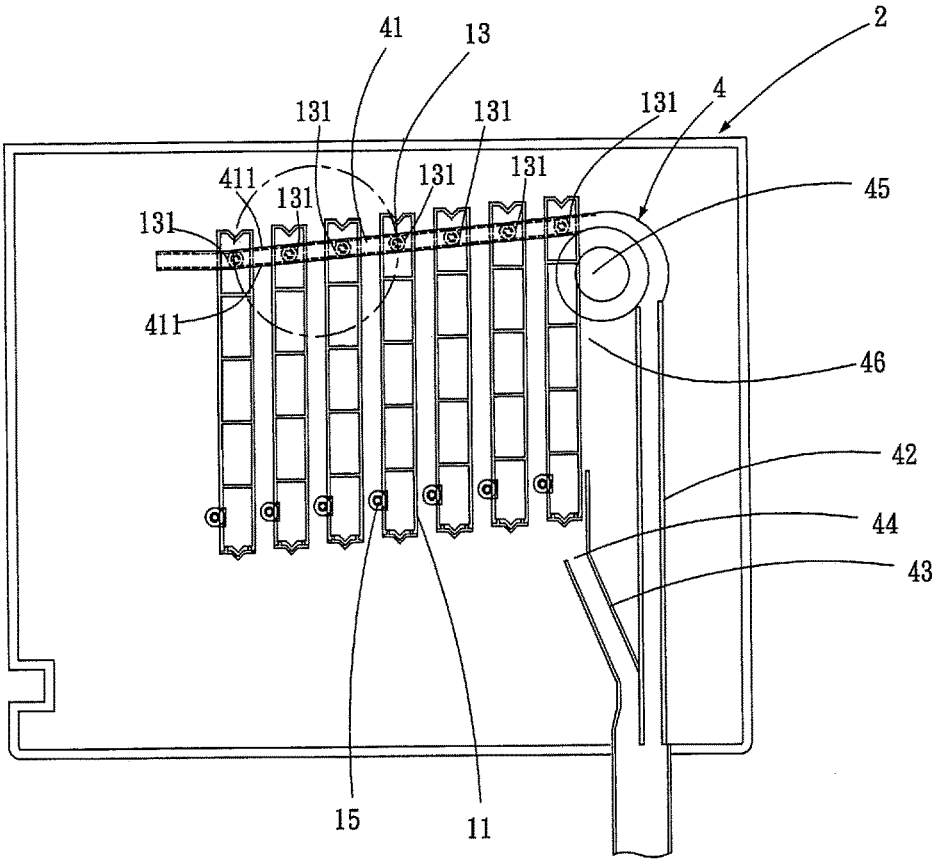
Figures 2, 7G:
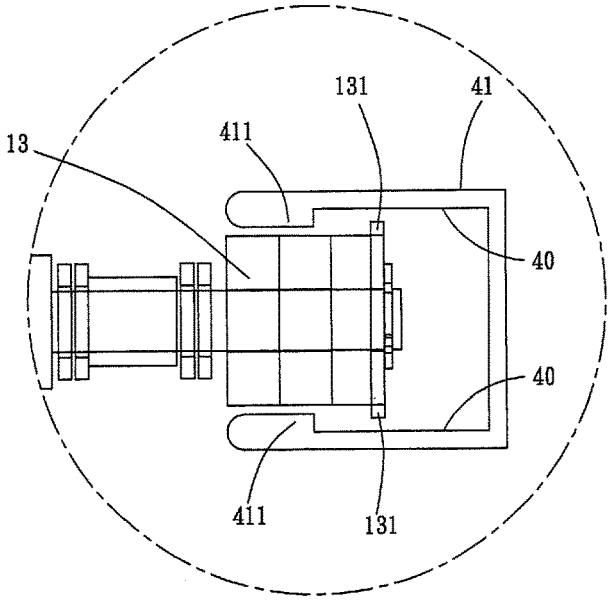

Moreover, two stoppers 47 are provided in the storage device 4 to stop a plurality of said door panels 11. With the design of stoppers 47, the occurrence of damage of a plurality of door panels caused by collision may be reduced to achieve the advantages for protection of door panel 11 structure and increase of door panel 11 life. Besides, because a certain gap exists wherever the chain 46 is connected pivotally with each of a plurality of door panels 11, as a plurality of said door panels 11 moves inwards to or outwards from the casing 2 along with the chain 46, a plurality of said door panels 11 may overlap mutually by the hand clamping prevention block piece 111 (as shown in FIG. 4) provided therewith. Therefore, there is no separation between a plurality of door panels 11 to achieve the advantage for safe operation of waterproof and flood protection. Also, as shown in FIGS. 7E-1, 7E-2, 7F-1 and 7F-2, which show a schematic view of an appearance for a fixation board of a storage device in a preferred embodiment of the invention, a schematic view of an enlarged appearance of FIG. 7E-1, a schematic view of an appearance for a chain guard board of the storage device and a schematic view of an enlarged view of FIG. 7F-1, wherein the overhead rail 41 of the storage device 4 is provided with a fixation board 481 and a chain guard board 482 thereon, the fixation board 481 allows the overhead rail 41 to form a fixed space, such that the bearing set 13 and the door panel 11 may move along with the overhead rail 41 more stably and freely without deflection from the overhead rail 41. Further, the chain guard board 482 may prevent links of the chain 46 from getting constricted and stuck tightly as the door panel 11 is shut, closed such that the door panel 11 is not raised, lowered smoothly. Hence, the additional installment of the chain guard board 482 achieves the advantage that the chain 46 is forced to be spread as the door panel 11 is lowered for the door panels 11 to be raised, lowered more smoothly. Besides, As shown in FIGS. 7G-1 and 7G-2, which are schematic views showing the appearance for two of the folding portions of the overhead rail of the storage device, wherein the upper edge and the lower edge of the overhead rail 41 of the storage device 4 are disposed with a folding portion 411, respectively, an internal space formed by the overhead rail 41 and the two folding portions 411 contains the flange 131 of the bearing set 13. With the installment of the folding portion 411 and the flange 131, the bearing set 13 may slide within the overhead rail 41 more stably to achieve the advantage that the bearing set 13 is kept from being detached and that the bearing set 13 is contained within the overhead rail 41.

Figure 8:
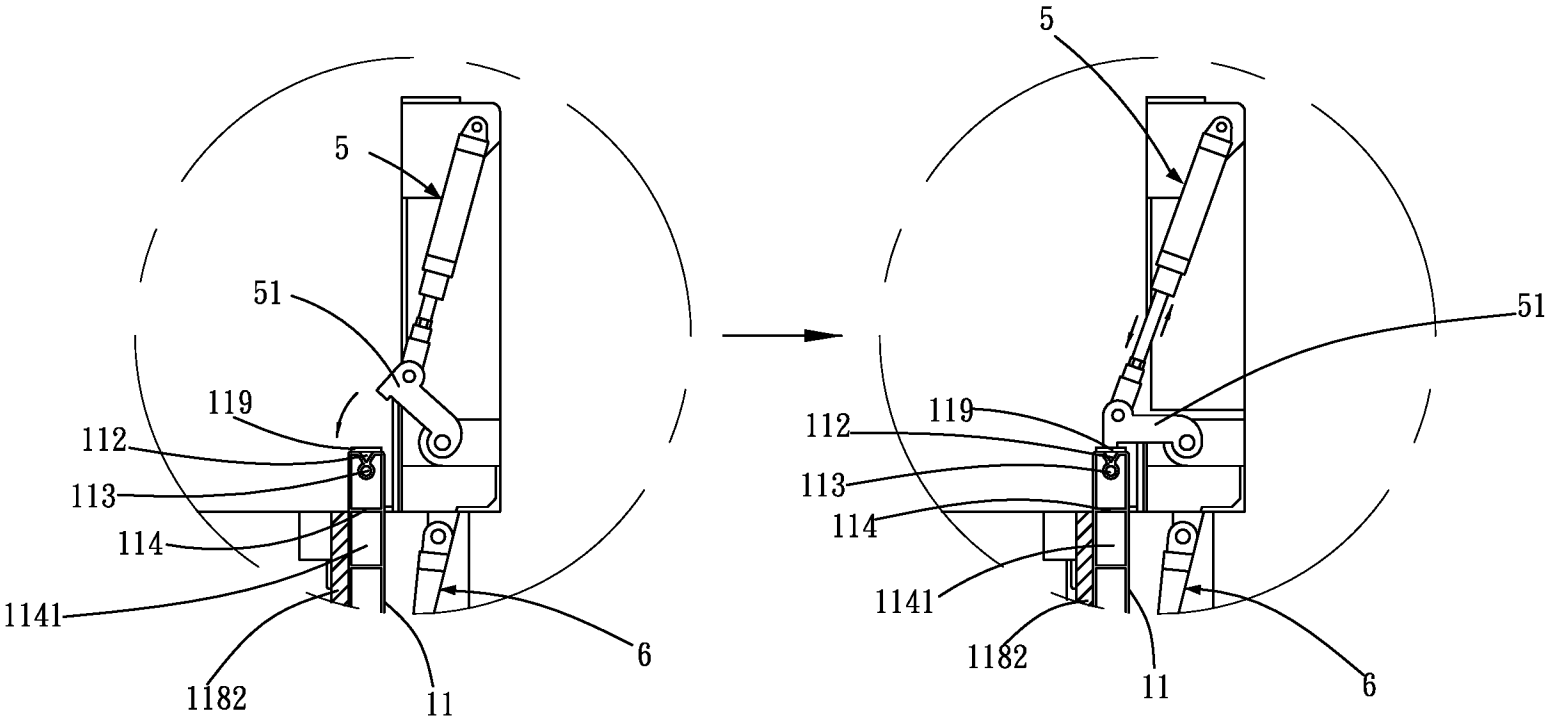
FIG. 8 is a lateral operation view showing a downward-pressing hydraulic cylinder of the automatic auto-sensing flood protection roller shutter with auto-locating reinforced column according to the invention.

Refer to FIG. 8, which is a lateral operation view showing a downward-pressing hydraulic cylinder of the automatic auto-sensing flood protection roller shutter with auto-locating reinforced column according to a preferred embodiment of the invention. As shown in the figure, after a plurality of door panels 11 are lowered and pushed horizontally for layers to be aligned and fit, the downward-pressing hydraulic cylinder 5 is pressed downwards for the downward-pressing plate 51 to press a plurality of door panels 11 with sealing gasket 118 disposed between each panel downwards to be waterproof to achieve the advantages for increase of airtight and waterproof and disaster prevention.

Figure 9:
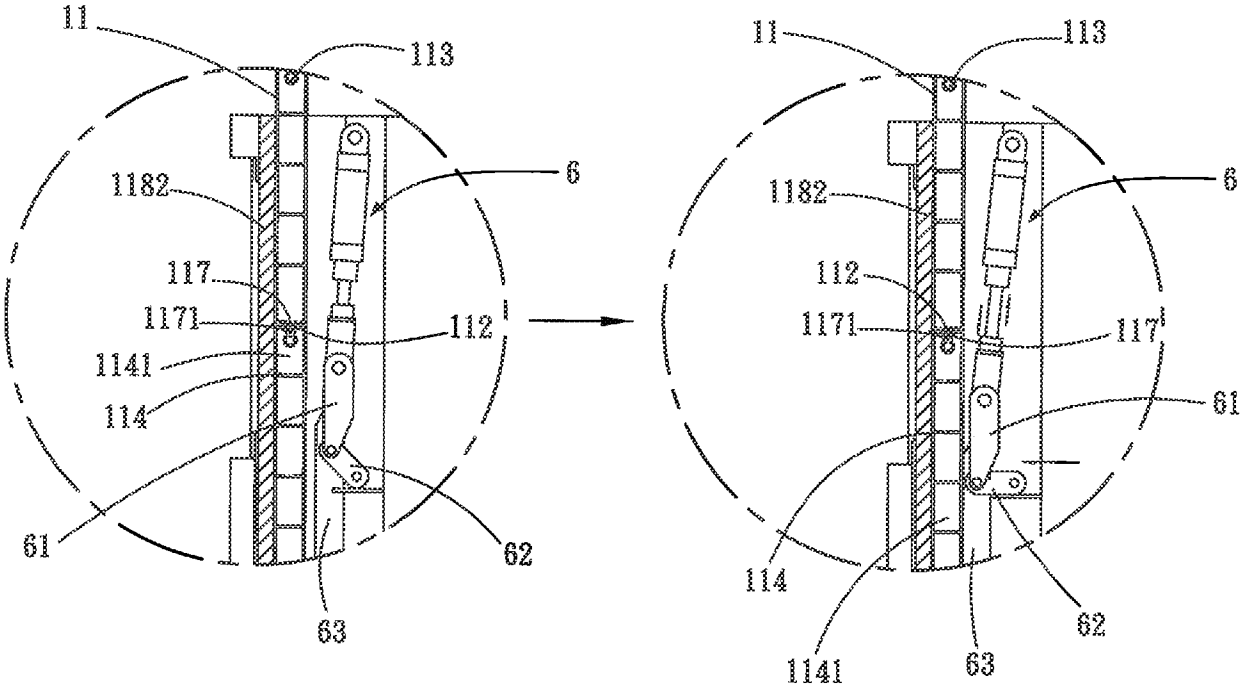
FIG. 9 is a lateral operation view showing a sideward-pressing hydraulic cylinder of the automatic auto-sensing flood protection roller shutter with auto-locating reinforced column according to the invention.
Figure 10:
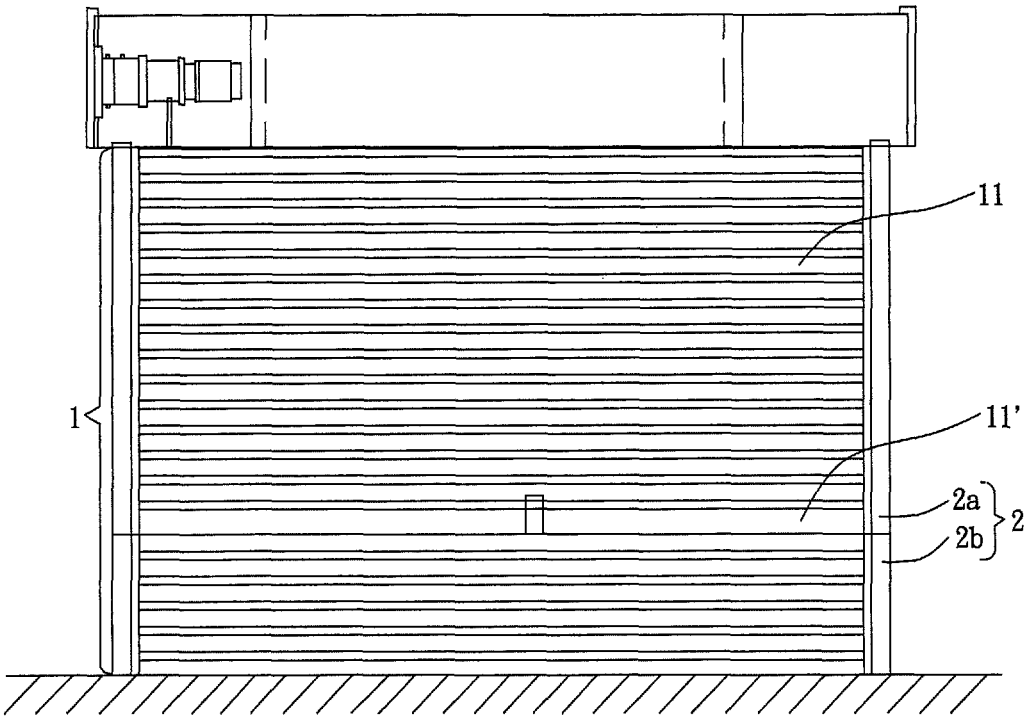
Fig. 10 Prior Art
FIG. 10 is an overall structural view showing an iron rolling door with escape structure of a prior art.
Figure 11:
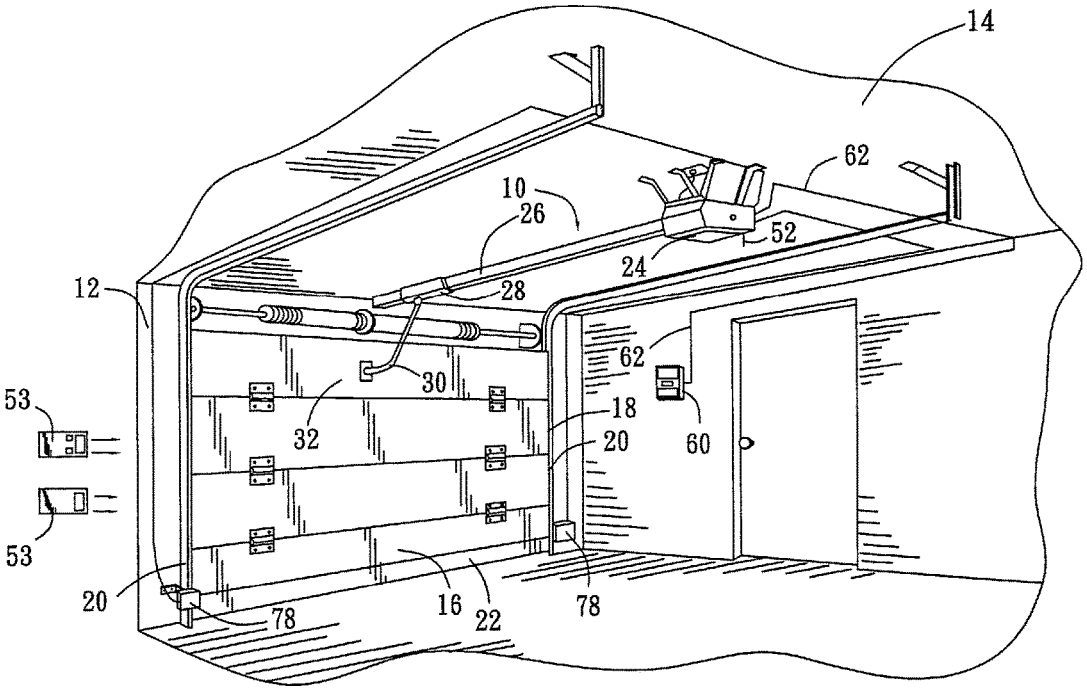
Fig. 11 Prior Art
FIG. 11 is a solid perspective view showing the prior art, Movable Barrier Operator Having Passive Infrared Detector.

Refer to FIG. 9, which is a lateral operation view showing a sideward-pressing hydraulic cylinder of the automatic auto-sensing flood protection roller shutter with auto-locating reinforced column according to a preferred embodiment of the invention. As shown in the figure, after a plurality of door panels 11 are lowered and pushed horizontally for layers to be aligned and fit, the downward-pressing hydraulic cylinder 5 is pressed downwards for the downward-pressing plate 51 to press a plurality of door panels 11 with sealing gasket 118 disposes between each panel downwards to be waterproof (as shown in FIG. 8), subsequently, the sideward-pressing hydraulic cylinder 6 presses downwards to drive the push lever 61 to induce the stop lever 62 to lower, as the stop lever 62 is lowered to a horizontal angle, the pressing plate 63 is stopped to push horizontally a plurality of door panels 11 for the waterproof glue strip 1172 to be more tight and fit therewith, such that the advantages for increase of airtight and waterproof and disaster prevention are achieved.

What mentioned above is one preferred embodiment of the invention. Besides, a second embodiment and a third embodiment of the automatic auto-sensing flood protection roller shutter with auto-locating reinforced column according to the invention are described as below.

In summary, from the content disclosed above, the invention does be capable of achieving the expected creation purpose. By said automatic auto-sensing flood protection roller shutter with auto-locating reinforced column, said roller shutter achieves the advantages of safe operation for waterproof and flood protection, strength enhancement for a plurality of door panels, stable movement for a plurality of door panels and equipment protection from damage, being airtight with waterproof, convenient containment, easy to use, protection of door panel structure and increase of door panel life, guidance of stable movement of reinforced column, waterproof and dustproof of retaining base, automatic closing of cover plate as not used, operation of automatic auto-sensing flood protection roller shutter, auto-locating of reinforced column and strength enhancement of waterproof and flood protection; thereby, as the flooding occurs, the automatically auto-sensing flood protection roller shutter of the invention may provide the water level detector activating the alarm value over the water level to transmit the signal to the automatic controller, the automatic controller activates the motors, vertical motors and horizontal motors to lower a plurality of door panels one by one for the flood protection shutter to be self-packed, and moves transversely the reinforced column to the retaining base, the bolt of the reinforced column is pushed automatically into the retaining base to enhance the flood protection strength of the shutter, further, downward pressure and sideward pressure forces of the downward-pressing hydraulic cylinder and the sideward-pressing hydraulic cylinder are applied to secure a plurality of door panels, the ground surface and the reinforced column closely and form airtight and waterproof, such that the functions and advantages of automatically auto-sensing flood protection without manual operation may be accomplished.

I claim:

1. An auto-sensing flood protection roller shutter with auto-locating reinforced column, including:

a door plate, which is composed of a plurality of door panels, which are movable between two frames mounted on two sides of the door plate from a position in which the door plate is stored in a storage device to an extended flood protection position;

a casing of the storage device, which is provided above the door plate and is provided with a motor, a hydraulic pump, an automatic controller, a power system, at least one downward-pressing hydraulic cylinder and a driving device in an interior of the casing of the storage device;

overhead rails extending in a horizontal direction between left and right inner walls of the storage device and guide rails extending in a vertical direction at each end of the overhead rails, one end of each of the guide rails being bonded respectively with a connecting branch rail, a gear being provided at respective connections between the overhead rails and the guide rails, a chain being engaged with each of the gears, and the chain being movable along the overhead rails and each of the guide rails to lower the door plate from storage in the storage device to the extended flood protection position;

the at least one downward-pressing hydraulic cylinder, which is provided in said casing, a downward-pressing plate being provided at a lower end of the hydraulic cylinder to press the door plate downwardly when the door plate is in the extended flood protection position;

at least one sideward-pressing hydraulic cylinder, which is provided in one of said frames, a push lever being connected to a lower end of the sideward-pressing cylinder;

a water level detector, which is provided in an underground space for a waterproof system to be turned on automatically once a certain water level is detected;

at least one reinforced column, which is provided behind the door plate, and a reinforced column driving motor to drive the reinforced column for movement relative to the door plate via a guiding screw and transmission shaft from a first non-reinforcing position to a door plate reinforcing position when the door plate is in the extended flood protection position, and a chamber at a lower end of the reinforced column being provided with a bolt and a bolt-driving motor for vertically driving the bolt into a retaining base to secure the reinforced column at the door plate reinforcing position; and wherein the reinforced column driving motor is provided in the driving device provided at a lower portion of the casing of the storage device, a fixation joint and a bearing set being provided at each of the two inner walls of the casing of the storage device, two ends of a guiding rod being fixed respectively in said two fixation joints, one end of the guiding screw and one end of the transmission shaft being fixed in said two bearing sets, wherein another end of said guiding screw and another end of said transmission shaft are mutually coupled.

2. The auto-sensing flood protection roller shutter with auto-locating reinforced column of claim 1, wherein a hand clamping prevention block piece for preventing an object from being caught between the door panels, a V-shaped groove and a door plate fixation hole are provided at upper ends of two lateral surfaces of each of the plurality of said door panels of the door plate, respectively, another hand clamping prevention block piece, an inverted V-shaped surface and two guide wheel anchor blocks are provided at lower ends of the two lateral surfaces of each of the plurality of said door panels, respectively, multiple diaphragms are provided in inner chambers of each of the plurality of said door panels to form multiple chambers, wherein a waterproof glue strip or sealing gasket is adhered to said V-shaped groove, said inverted V-shaped surface and a surface between said door panel and said frame.

3. The auto-sensing flood protection roller shutter with auto-locating reinforced column of claim 2, wherein the door plate fixation hole in each of the plurality of said door panels receives one end of an axis shaft provided in a bearing set for supporting a respective guide wheel; and the anchor blocks in each of the plurality of said door panels are fixed to a guide wheel fixation plate and arranged to at least partially surround the respective guide wheel.

4. The auto-sensing flood protection roller shutter with auto-locating reinforced column of claim 1, wherein an infrared detector is provided on or in one of said two frames to detect a situation requiring stoppage of door plate movement as the door plate approaches a ground surface; or an infrared detector is mounted on an exterior of the roller shutter to detect proximity of a person, vehicle or object that would require said stoppage of door plate movement.

5. The auto-sensing flood protection roller shutter with auto-locating reinforced column of claim 1, wherein two stoppers are provided in the storage device to stop the plurality of said door panels, an opening of said branch rail is provided with a guiding opening expanding outwards, and a movement fixation board is installed above the overhead rails to stabilize movement of a corresponding said door panel along the overhead rail, wherein an upper edge and a lower edge of the overhead rails are provided with respective folding portions each containing a flange for retaining bearing sets that movably support the door panels.

6. The auto-sensing flood protection roller shutter with auto-locating reinforced column of claim 1, further comprising at least one additional downward-pressing hydraulic cylinder, at least one additional sideward-pressing hydraulic cylinder, or at least one additional downward-pressing hydraulic cylinder and at least one additional sideward-pressing hydraulic cylinder.

7. The auto-sensing flood protection roller shutter with auto-locating reinforced column of claim 1, wherein a top of the reinforced column is guided by said guiding rod and guiding screw of the driving device, a bottom of the reinforced column is movable along a track, and a ball is provided at the bottom of the reinforced column to stabilize the movement of said reinforced column on the track.

8. The auto-sensing flood protection roller shutter with auto-locating reinforced column of claim 1, wherein said water level detector performs sensing and detection and sends a signal to said automatic controller, said automatic controller may control movement of said door plate, downward-pressing hydraulic cylinder, sideward-pressing hydraulic cylinder and reinforced column according to said signal.

9. The auto-sensing flood protection roller shutter with auto-locating reinforced column as claimed in claim 1, further comprising a second reinforced column and a second reinforced column driving motor positioned at a top of the second reinforced column to drive the second reinforced column via a gearbox for transverse movement relative to the first reinforced column, wherein the second reinforced column is driven by the second reinforced column driving motor from the door plate reinforcing position to a second reinforcing position after the first and second reinforced columns have been driven by the first reinforced column driving motor via the transmission shaft and guiding screw from an initial position to the door plate reinforcing position.

10. The auto-sensing flood protection roller shutter with auto-locating reinforced column as claimed in claim 1, wherein said retaining base is provided with a cover plate and a spring against which the bolt is pressed upon being driven by the bolt-driving motor into the retaining base.

* * * * *